US009472147B2

(12) United States Patent
Park

(10) Patent No.: US 9,472,147 B2
(45) Date of Patent: Oct. 18, 2016

(54) DISPLAY APPARATUS

(71) Applicant: SAMSUNG DISPLAY CO., LTD., Yongin, Gyeonggi-Do (KR)

(72) Inventor: Dong-Won Park, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 49 days.

(21) Appl. No.: 14/535,218

(22) Filed: Nov. 6, 2014

(65) Prior Publication Data

US 2015/0302811 A1 Oct. 22, 2015

(30) Foreign Application Priority Data

Apr. 17, 2014 (KR) ..... 10-2014-0046174

(51) Int. Cl.
*G09G 3/36* (2006.01)

(52) U.S. Cl.
CPC .... *G09G 3/3614* (2013.01); *G09G 2300/0413* (2013.01); *G09G 2300/0426* (2013.01)

(58) Field of Classification Search
None
See application file for complete search history.

(56) References Cited

U.S. PATENT DOCUMENTS

| | | | | |
|---|---|---|---|---|
| 6,787,987 | B2 | 9/2004 | Duineveld et al. | |
| 7,479,642 | B2 | 1/2009 | Maack | |
| 8,339,430 | B2 | 12/2012 | Choi et al. | |
| 2008/0068324 | A1* | 3/2008 | Chung | G09G 3/006 345/98 |
| 2008/0158124 | A1* | 7/2008 | Kim | G09G 3/3648 345/92 |
| 2008/0158452 | A1* | 7/2008 | Wu | G02F 1/133753 349/34 |
| 2015/0262554 | A1 | 9/2015 | Park et al. | |
| 2015/0348455 | A1 | 12/2015 | Jeon et al. | |

FOREIGN PATENT DOCUMENTS

| | | | |
|---|---|---|---|
| JP | 5189276 | B2 | 6/2008 |
| KR | 10-1026802 | B1 | 5/2005 |
| KR | 10-2011-0042674 | A | 4/2011 |
| KR | 10-2015-0107943 | | 9/2015 |
| KR | 10-2015-0139131 | | 12/2015 |

OTHER PUBLICATIONS

Japanese Patent Abstract for JP 2008-135333 B2, which corresponds to JP Publ. No. 5189276 B2, published Jun. 12, 2008, 1 page.
Korean Patent Abstract for KR 2005-0047756 A, which corresponds to KR Publ. No. 10-1026802 B1, published May 23, 2005, 2 pages.

* cited by examiner

*Primary Examiner* — Joseph Haley
*Assistant Examiner* — Emily Frank
(74) *Attorney, Agent, or Firm* — Lewis Roca Rothgerber Christie LLP

(57) ABSTRACT

A display device includes a display panel, a timing controller, a gate driver, and a data driver. The display panel includes a display area for displaying an image and a non-display area adjacent to one side of the display area. The display area includes gate lines, data lines, gate dummy lines, a data contact portion, and pixels. The data lines cross and are isolated from at least a part of the gate lines. The gate dummy lines are parallel with and are spaced from the gate lines. The data contact portion couples the gate dummy lines and the data lines at one side of a second direction perpendicular to the first direction.

18 Claims, 16 Drawing Sheets

DISPLAY APPARATUS

CROSS-REFERENCE TO RELATED APPLICATION

This application claims priority to and the benefit of Korean Patent Application No. 10-2014-0046174 filed Apr. 17, 2014, in the Korean Intellectual Property Office, the entire contents of which are hereby incorporated by reference.

FIELD

The concepts described herein relate to a display device, and more particularly, relate to a display device including a display panel with a structure capable of implementing narrow bezel.

BACKGROUND

In recent years, a Brown tube (or a cathode-ray tube) has been replaced with display devices, such as a liquid crystal display device, an electrophoresis display device, an organic light-emitting display device, and so on.

The display device encompasses a display panel, a gate driver, and a data driver. The display panel has a display area for displaying images and a non-display area surrounding the display area. The display panel further includes gate lines, data lines, and pixels coupled to the gate lines and the data lines.

The display panel has a rectangular shape that has a first edge extending in a first direction and a second edge intersecting the first direction when viewed from the top. The gate lines are arranged side by side in the first direction, and the data lines are arranged side by side in the second direction.

As a driver integrated circuit, the gate driver is mounted on a printed circuit board which is coupled to the first-direction non-display area of the display panel. The gate driver is provided directly on the first-direction non-display area of the display panel through a thin film process.

A research for minimizing the non-display area (bezel) of the display panel is performed to cope with a consumer's need. However, a conventional display panel structure has a limit to removing the first-direction non-display area of the display panel because of a location of the gate driver.

SUMMARY

A display device according to an aspect of an embodiment of the present invention includes: a display panel including a display area for displaying an image and a non-display area adjacent the display area at one side in a first direction, wherein the display area includes: a plurality of gate lines; a plurality of data lines crossing at least a part of the plurality of gate lines, the at least the part of the plurality of gate lines being isolated from the plurality of data lines; a plurality of gate dummy lines spaced apart from and being parallel with the plurality of gate lines; a data contact portion coupling a gate dummy line of the plurality of gate dummy lines and a data line of the plurality of data lines at one side of the display area in a second direction perpendicular to the first direction; and a plurality of pixels each coupled to a gate line of the plurality of gate lines and the data line; a timing controller configured to output a first control signal, a second control signal, and a data signal in response to the first control signal and an input image signal; a gate driver configured to generate a gate signal based on the first control signal and to output the gate signal to the plurality of gate lines via the non-display area; and a data driver including a plurality of channels, wherein based on the second control signal, the data driver is configured to invert a polarity of a data voltage obtained by converting the data signal, by the plurality of channels, and output the data voltage with the inverted polarity to the plurality of channels, the data voltage being provided to the plurality of data lines via the non-display area.

The display area further includes: data dummy lines spaced from and parallel with the plurality of data lines; and a gate contact portion coupling the data dummy lines and the plurality of gate lines at a second side of the display area in the second direction.

The display panel includes two edges extending in the first direction and the second direction, and wherein the plurality of gate lines extend in a third direction intersecting the first and second directions, and the plurality of data lines extend in a fourth direction intersecting the first, second, and third directions.

A number of pixels coupled to a gate line from among the pixels is even, and the pixels, coupled to a gate line from among the pixels form a gate pixel row.

A polarity of a data voltage applied to the gate pixel row is inverted by the pixel.

A polarity of a data voltage applied to a first pixel of the gate pixel row is different from a polarity of a data voltage applied to a last pixel of a same gate pixel row.

The data voltages applied to pixels, coupled to a data line from among the pixels have a same polarity, and the pixels coupled to a data line from among the pixels form a data pixel row.

The data driver inverts polarities of data voltages output from the channels every frame.

The display area further includes data paths that are respectively coupled to the channels and are configured to receive voltages.

The data paths are configured such that at least one intersection data pair formed of two data paths coupled to two adjacent channels and intersect each other, and at least one non-intersection data pair formed of two data paths coupled to two adjacent channels and do not intersect, are arranged alternatingly such that the intersection data pair is non-continuous.

The plurality of pixels coupled to the plurality of gate lines or the plurality of data lines, from among the plurality of pixels are defined as a pixel row, wherein the display area further includes a plurality of areas, each of the plurality of areas comprising a plurality of pixel rows, and wherein a number of pixels in one pixel rows in at least one of the plurality of areas is different from the number of pixels in another pixel row.

The plurality of areas include: an increasing area where the number of pixels in each pixel row increases by at least one pixel; a maintaining area where each of the pixel rows include a same number of pixels; and a decreasing area where the number of pixels in each pixel row decreases by at least one pixel.

Each of the pixels includes k sub-pixels, wherein k is a natural number of 2 or more, wherein each of the data lines includes k sub data lines respectively coupled to the sub-pixels, wherein each of the gate dummy lines includes k sub gate dummy lines respectively coupled to the sub data lines, and wherein the data contact portion includes k sub data contact portions coupling the k sub data lines and the k sub gate dummy lines.

The timing controller comprises: a frame memory configured to store current frame data of the input image signal and output previous frame data of the input image signal; and a data signal generation unit configured to sort the previous frame data to generate the data signal.

The display panel comprises two edges extending in the first direction and the second direction, and displays a target image, wherein the input image signal is a signal for displaying the target image when the plurality of gate lines extend in the first direction and the plurality of data lines extend in the second direction, and wherein the data signal is a signal for displaying the target image when the plurality of gate lines extend in a third direction intersecting the first and second directions and the data lines extend in a fourth direction intersecting the first, second, and third directions.

A display device according to another aspect of an embodiment of the present invention includes: a display panel including a display area configured to display an image and a non-display area adjacent to one side of the display area, the display area including two edges extending in a first direction and a second direction different from the first direction, diagonal lines, intersectional lines intersecting and isolated from at least a part of the diagonal lines, and pixels coupled to a diagonal line or an intersectional line and arranged in a line in one direction, from among the pixels defined as a pixel row; a timing controller configured to receive a control signal and an input image signal and to output a first control signal, a second control signal, and a data signal; a gate driver configured to generate a gate signal based on the first control signal and to output the gate signal to the diagonal lines and the intersectional lines via the non-display area; and a data driver configured to output a data voltage obtained by converting the data signal to the diagonal lines and the intersectional lines via the non-display area in response to the second control signal, wherein the display area further includes a plurality of areas, each of the plurality of areas including a plurality of pixel rows, and a number of pixels constituting one of the pixel rows in at least one of the plurality of areas is different from the number of pixels constituting another pixel row, and wherein the diagonal lines extend in a third direction, intersecting the first direction and the second direction at one end of the display area adjacent the non-display area, wherein the intersectional lines extend in a fourth direction, intersecting the first, second, and third directions, at the one end of the display area, and wherein the timing controller includes a frame memory configured to store current frame data of the input image signal and output previous frame data of the input image signal and a data signal generation unit adapted to sort the previous frame data to generate the data signal.

A display device according to another aspect of an embodiment of the present invention includes: a display panel including a display area for displaying an image, a first non-display area adjacent to one side of the display area, and a second non-display area adjacent to another side of the display area, the display area including two edges extending in first and second directions that are different from each other, gate lines, data lines crossing and isolated from at least the part of the gate lines, and pixels coupled to a gate line or a data line, from among the pixels defined as a pixel row; a timing controller configured to receive a control signal and an input image signal and to output a first control signal, a second control signal, and a data signal; a gate driver configured to generate a gate signal based on the first control signal and to output the gate signal to the gate lines via the first and second non-display areas; and a data driver configured to output a data voltage obtained by converting the data signal to the data lines via the first and second non-display areas in response to the second control signal, wherein the display area further includes a plurality of areas, each of the plurality of areas including a plurality of pixel rows, and a number of pixels constituting one of the pixel rows in at least one of the plurality of areas is different from the number of pixels constituting another pixel row, wherein the gate lines extend a third direction intersecting the first and second directions, wherein the data lines extend a fourth direction intersecting the first, second, and third directions, and wherein the timing controller includes a frame memory configured to store current frame data of the input image signal and to output previous frame data of the input image signal and a data signal generation unit configured to sort the previous frame data to generate the data signal.

A display device according to another aspect of an embodiment of the present invention includes: a display panel including a display area configured to display an image and a non-display area adjacent to one side of the display area, the display area including two edges extending in a first direction and a second direction different from the first direction, gate lines, data lines intersecting and isolated from at least the part of the gate lines, and pixels coupled to a gate line or a data line, from among the pixels being defined as a pixel row; a timing controller configured to receive a control signal and an input image signal and to output a first control signal, a second control signal, and a data signal; a gate driver configured to generate a gate signal based on the first control signal and to output the gate signal to the gate lines via the non-display area; and a data driver configured to output a data voltage obtained by converting the data signal to the data lines via the non-display area in response to the second control signal, wherein the display area further includes a plurality of areas, each of the plurality of areas including a plurality of pixel rows, and a number of pixels constituting one of the pixel rows in at least one of the plurality of areas is different from the number of pixels constituting another pixel row, wherein the gate lines extend in the first direction and the data lines extend in a third direction crossing the first direction and the second direction, and wherein the timing controller includes a frame memory configured to store current frame data of the input image signal and output previous frame data of the input image signal and a data signal generation unit adapted to sort the previous frame data to generate the data signal.

BRIEF DESCRIPTION OF THE DRAWINGS

The above and other features and aspects will become apparent from the following description with reference to the following figures, wherein like reference numerals refer to like parts throughout the various figures unless otherwise specified, and wherein.

DETAILED DESCRIPTION

Figure 1:
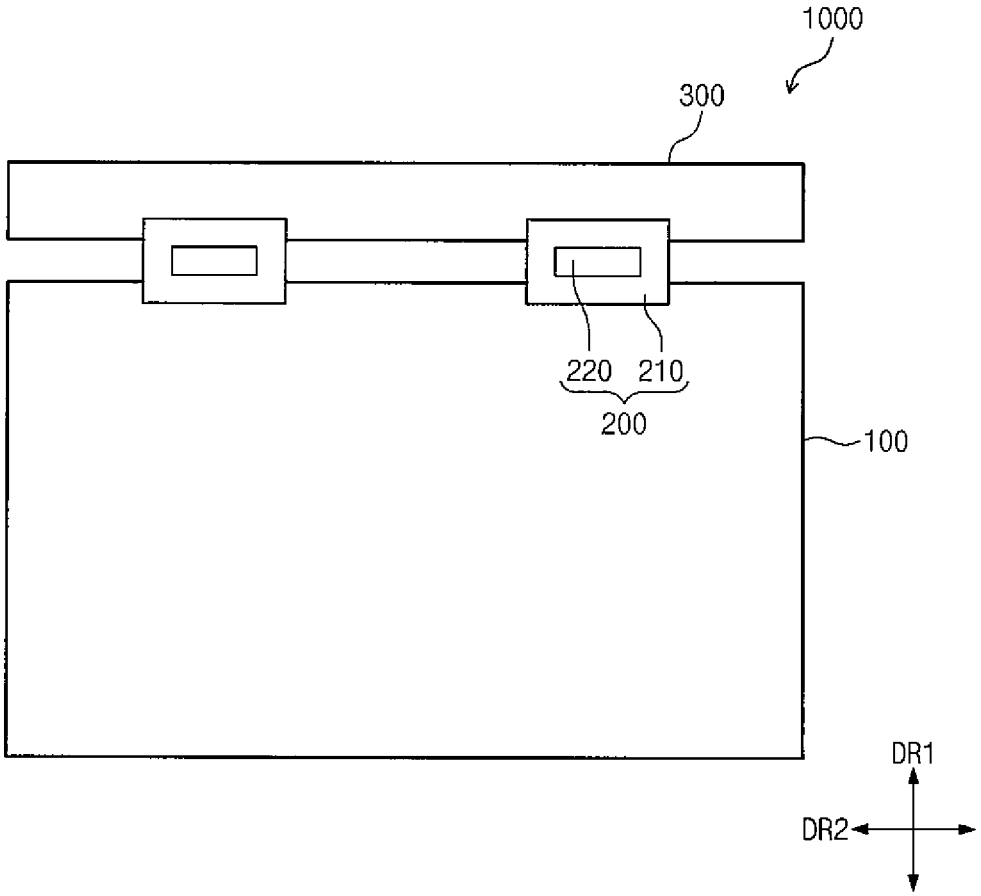
FIG. 1 is a diagram schematically illustrating a display device according to an embodiment of the inventive concept.

Embodiments will be described in detail with reference to the accompanying drawings. The inventive concept, however, may be embodied in various different forms, and should not be construed as being limited only to the illustrated embodiments. Rather, these embodiments are provided as examples so that this disclosure will be thorough and complete, and will fully convey the concept of the inventive concept to those skilled in the art. Accordingly, known processes, elements, and techniques are not described with respect to some of the embodiments of the inventive concept. Unless otherwise noted, like reference numerals denote like elements throughout the attached drawings and written description, and thus descriptions will not be repeated. In the drawings, the sizes and relative sizes of layers and regions may be exaggerated for clarity.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Also, the term "exemplary" is intended to refer to an example or illustration.

It will be understood that when an element or layer is referred to as being "on", "connected to", "coupled to", or "adjacent to" another element or layer, it can be directly on, connected, coupled, or adjacent to the other element or layer, or intervening elements or layers may be present. When an element is referred to as being "directly on," "directly connected to", "directly coupled to", or "immediately adjacent to" another element or layer, there are no intervening elements or layers present.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Figure 2:
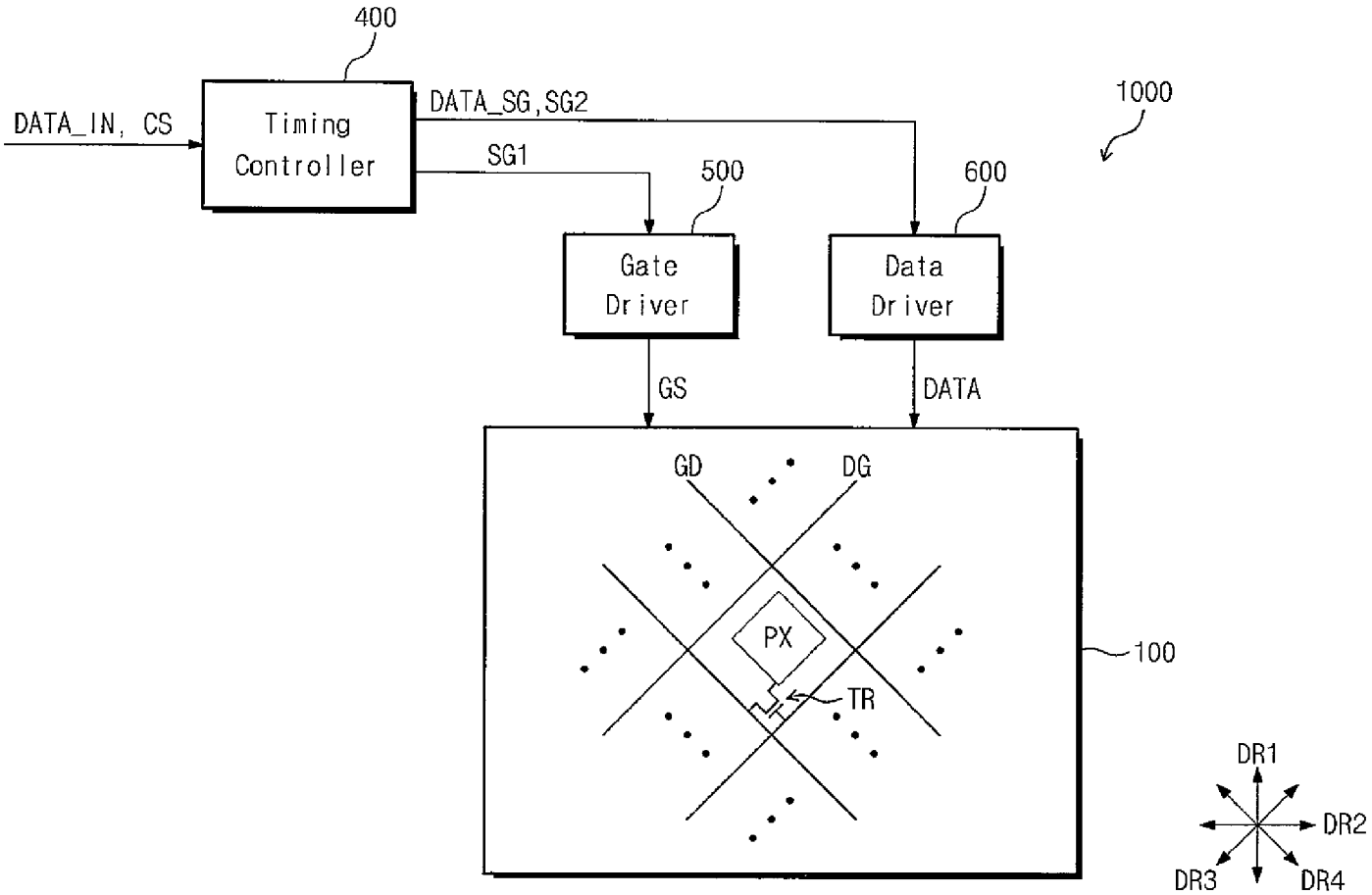
FIG. 2 is a block diagram schematically illustrating a display device shown in FIG. 1.

FIG. 1 is a diagram schematically illustrating a display device 1000 according to an embodiment of the inventive concept. FIG. 2 is a block diagram schematically illustrating a display device 1000 shown in FIG. 1.

Referring to FIGS. 1 and 2, a display device 1000 includes a display panel 100, a flexible printed circuit board 200, a printed circuit board 300, a timing controller 400, a gate driver 500, and a data driver 600.

The display panel 100 may include a variety of display panels including, but not limited to, an organic light emitting display panel (e.g., an organic light emitting diode (OLED) display panel), a liquid crystal display panel, a plasma display panel, an electrophoretic display panel, and an electrowetting display panel.

The display panel 100 displays images. The display panel 100 includes gate lines GL and data lines DL, and the data lines DL are arranged to be isolated from at least a part of the gate lines GL. The display panel 100 contains a thin film transistor TR coupled to two lines, for example, a gate line and a data line, and a pixel PX coupled to the thin film transistor TR. The thin film transistor TR has a gate electrode, a source electrode, and a drain electrode. To the gate electrode is provided a gate signal from a corresponding gate line. To the source electrode is provided a data voltage via a corresponding data line. The drain electrode is coupled to the pixel PX. The thin film transistor TR provides the data voltage to the pixel PX in response to the gate signal.

The gate lines GL are supplied with a gate signal GS provided from the gate driver 500, and the data lines DL are supplied with a data voltage DATA provided from the data driver 600. The display panel including the gate lines GL and the data lines DL that are configured as described above will be described in more detail later.

A shape of the display panel 100, when viewed from the top, may be of various shapes. Below, it is assumed that the display panel 100 has a rectangular shape when viewed from the top. A direction of a short-edge side of the display panel 100 may be defined as a first direction DR1, and a direction of a long-edge side of the display panel 100 may be defined as a second direction DR2.

The flexible printed circuit board 200 couples the display panel 100 and the printed circuit board 300 electrically. The flexible printed circuit board 200 includes a base film 210 and an integrated circuit chip 220 formed on the base film 210.

One end in the first direction DR1 of the flexible printed circuit board 200 is electrically coupled to the display panel 100, and the other end thereof is coupled to the printed circuit board 300 electrically.

In FIG. 1, there is illustrated an example where the display device 1000 includes two flexible printed circuit boards 200 spaced apart from each other in the second direction DR2. However, the inventive concept is not limited thereto. For example, the number of flexible printed circuit board 200 may be changed variously.

In some embodiments, the flexible printed circuit board 200 is flexible. The flexible printed circuit board 200 may be bent into a "C" shape and mounted on the back of the flexible printed circuit board 200.

The printed circuit board 300 plays a role of driving the display panel 100. In some embodiments, the printed circuit board 300 is formed of a driver substrate and a plurality of circuit parts mounted on the driver substrate. The printed circuit board 300 is mounted on the back of the display panel 100 with the flexible printed circuit board 200 bent and mounted.

The timing controller 400 receives an input image signal DATA_IN and a control signal CS from an external graphics controller.

The timing controller 400 generates a first control signal SG1 and a second control signal SG2 in response to the control signal CS, for example, a vertical synchronization signal, a horizontal synchronization signal, a main clock, a data enable signal, and so on.

The timing controller 400 converts the input image signal DATA_IN into a data signal DATA_SG to be suitable for the specification of the data driver 600 and outputs the data signal DATA_SG to the data driver 600.

The first control signal SG1 may be a gate control signal for controlling an operation of the gate driver 500. The first control signal SG1 may include, but not be limited to, a gate clock, an output enable signal, and a vertical start signal.

The second control signal SG2 may be a data control signal for controlling an operation of the data driver 600. The second control signal SG2 may include, but not be limited to, a horizontal start signal indicating the beginning of an operation of the data driver 600, an inversion signal for inverting a polarity of a data voltage, and an output direction signal for deciding timing when a data voltage is output from the data driver 600.

The gate driver 500 generates the gate signal in response to the first control signal SG1. The gate driver 500 is coupled electrically to the gate lines GL and provides the gate signal to the gate lines GL.

The data driver 600 provides the data lines DL with the data voltage DATA, which is a result of converting the data signal DATA_SG, in response to the second control signal SG2.

The gate driver 500 and the data driver 600 may be formed in one unified integrated circuit chip 220. However, the inventive concept is not limited thereto. The gate driver 500 and the data driver 600 may be formed of independent chips, which are mounted on the flexible printed circuit board 200, the printed circuit board 300, or the display panel 100.

Figure 3:
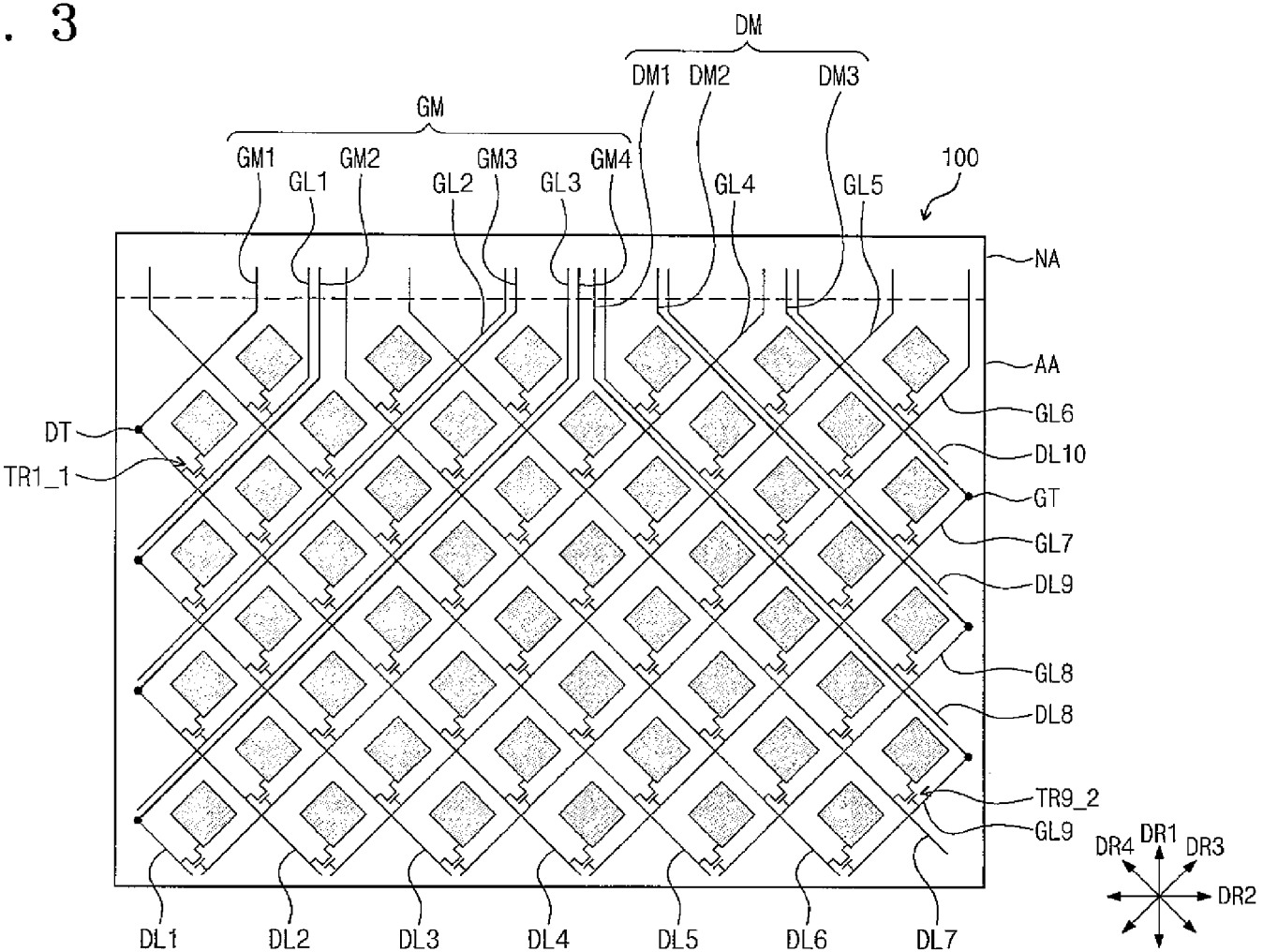
FIG. 3 is a diagram schematically illustrating a display panel shown in FIG. 1.
Figure 4:
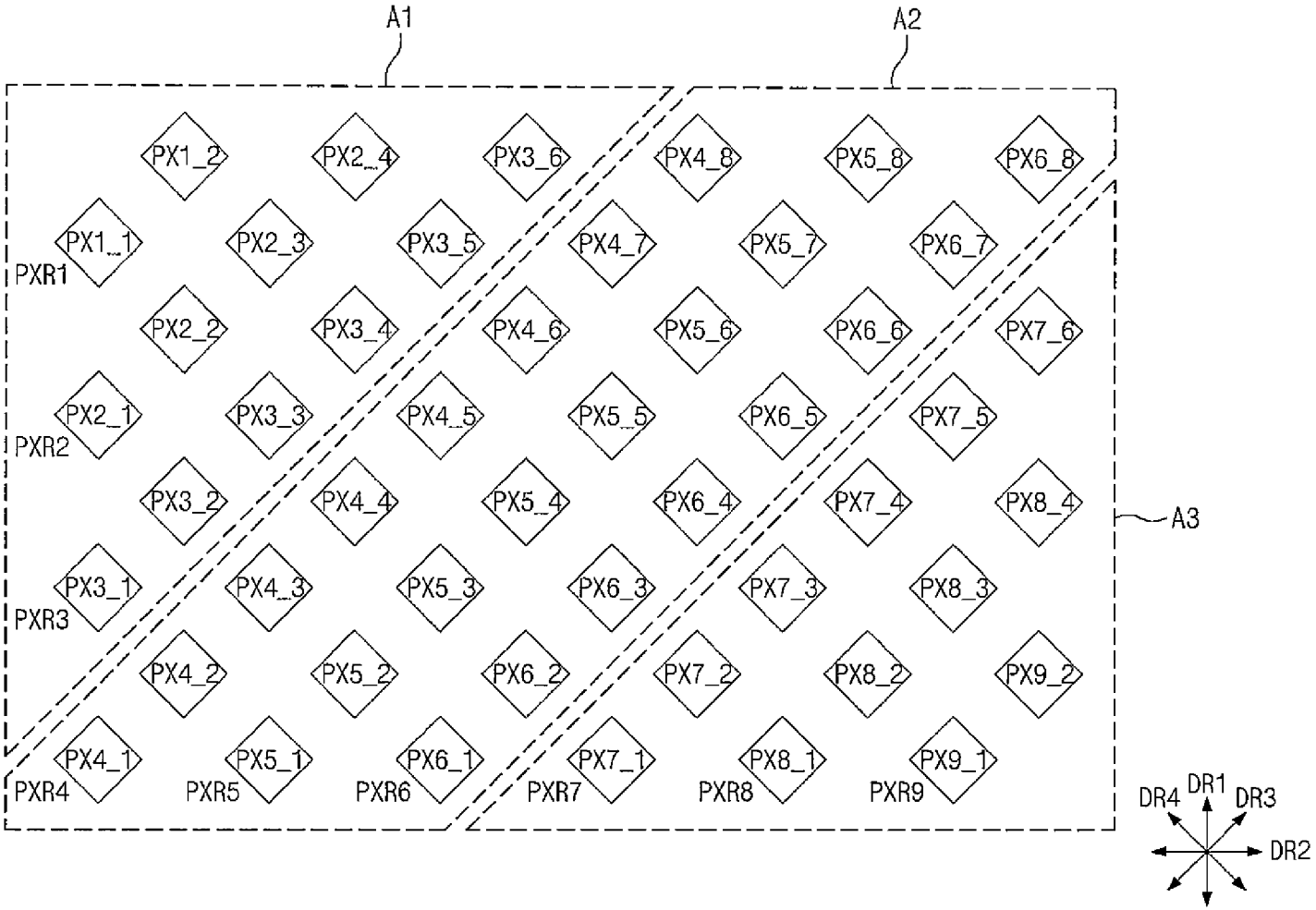
FIG. 4 is a diagram schematically illustrating pixels shown in FIG. 3.

FIG. 3 is a diagram schematically illustrating a display panel 100 shown in FIG. 1. FIG. 4 is a diagram schematically illustrating pixels shown in FIG. 3.

Referring to FIGS. 2 and 4, a display panel 100 includes a display area AA and a non-display area NA. The display area AA displays images and includes gate lines GL, data lines DL, and pixels PX. The non-display area NA may be an area where images are not displayed, and it may be formed at a periphery of the display panel 100. The non-display area NA may be an area that is adjacent to one side of the display area AA in the first direction DR1. A pad portion may be provided in the non-display area NA. The pad portion may be coupled to the gate lines GL and the data lines DL to provide the gate lines GL and the data lines DL with a gate signal GS from a gate driver 500 (refer to FIG. 2) and a data voltage DATA from a data driver 600 (refer to FIG. 2).

The gate lines GL and the data lines DL may extend in a diagonal direction with respect to the first direction DR1 and the second direction DR2. The gate lines GL and the data lines DL that extend in the diagonal direction may mean that they extend in a straight-line and/or that they extend in a zigzag pattern such that the extending direction becomes the diagonal direction.

The gate lines GL may extend in a third direction DR3 that intersects the first direction DR1 and the second direction DR2. The data lines DL may extend in a fourth direction DR4 that intersects the first to third directions DR1 to DR3. An angle between the third direction DR3 and the fourth direction DR4 may be set variously: 30°, 45°, 60°, and so on. Below, it is assumed that an angle between the third direction DR3 and the fourth direction DR4 is 90°.

The gate lines GL may be in a plurality, and the data lines DL may be in plurality. For example, in FIG. 3, the gate lines GL include $1^{st}$ to $9^{th}$ gate lines GL1 to GL9, and the data lines DL include $1^{st}$ to $10^{th}$ data lines DL1 to DL10.

The pixels PX are provided at pixel areas that are defined by the $1^{st}$ to 9th gate lines GL1 to GL9 and the $1^{st}$ to $10^{th}$ data lines DL1 to DL10. When viewed from the top, shapes of the pixels PX may be changed or modified variously according to arrangement of the gate lines GL and the data lines DL. In FIGS. 3 and 4, there is illustrated an example where each pixel PX has a diamond shape.

Among the pixels PX, the pixels that are coupled to a gate line GL or a data line DL may be defined as a pixel row. The pixel row may include a gate pixel row, which is formed of pixels coupled to a gate line, and a data pixel row, which is formed of pixels coupled to a data line. The gate pixel row may include $1^{st}$ to $9^{th}$ pixel rows PXR1 to PXR9.

Below, when a specific pixel is named, a number of a gate pixel row to which the specific pixel belongs may be referenced together with a symbol indicating a location of the specific pixel placed in the gate pixel row on the basis of the third direction DR3 from a left corner to a right corner. For example, since a pixel PX1_1 coupled to the first gate line GL1 and the fourth data line DL4 is a first pixel of a first gate pixel row, it is defined as a $1^{st}$-row first pixel PX1_1.

In a similar way, a thin film transistor coupled to the $1^{st}$-row first pixel PX1_1 is defined as a $1^{st}$-row first thin film transistor TR1_1.

In FIGS. 3 and 4, there are illustrated an example where $1^{st}$ to $9^{th}$ pixel includes $1^{st}$ to $9^{th}$ gate pixel rows, that is, 48 pixels. Also, there is described an example where thin film transistors are formed of 48 thin film transistors TR1_1 to TR9_2 coupled to the pixels PX1_1 to PX9_2.

The number of pixels in one of two adjacent pixel rows may be different from that in the other pixel row. The display area AA is divided into three areas by the pixel rows, based on whether the number of pixels in each pixel row increases, is maintained, or decreases on the basis of adjacent pixel rows. The three areas may include an increasing area A1, a maintaining area A2, and a decreasing area A3. Below, a description will be made on the basis of a gate pixel row.

The increasing area A1 includes $1^{st}$ to $3^{rd}$ gate pixel rows PXR1 to PXR3. The number of pixels in each gate pixel row may increase in an arithmetic sequence every at least one gate pixel row toward the third gate pixel row PXR3 from the first gate pixel row PXR1. Referring to FIGS. 3 and 4, the $1^{st}$ gate pixel row PXR1 includes two pixels. Because the number of pixels increases by 2 whenever a row changes (e.g., adjacent pixel row), the $3^{rd}$ gate pixel row PXR3 includes six pixels. However, the inventive concept is not limited thereto. For example, the number of pixels in each gate pixel row may increase every gate pixel row. According to another example embodiment, the number of pixels in the $1^{st}$ gate pixel row may be equal to that in the $2^{nd}$ gate pixel row. The number of pixels in the $3^{rd}$ gate pixel row may be greater than that in each of the $1^{st}$ and $2^{nd}$ gate pixel rows.

The maintaining area A2 includes $4^{th}$ to $6^{th}$ gate pixel rows PXR4 to PXR6, in which each of the pixel rows includes the same number of pixels. In FIGS. 3 and 4, each of the $4^{th}$ to $6^{th}$ gate pixel rows PXR4 to PXR6 may include 8 pixels.

The decreasing area A3 includes $7^{th}$ to $9^{th}$ gate pixel rows PXR7 to PXR9. The number of pixels in each gate pixel row may decrease in an arithmetic sequence every at least one gate pixel row toward the $9^{th}$ gate pixel row PXR9 from the $7^{th}$ gate pixel row PXR7. Referring to FIGS. 3 and 4, the $7^{th}$ gate pixel row PXR7 includes 6 pixels. Because the number of pixels decreases by 2 whenever a row changes, the $9^{th}$ gate pixel row PXR9 includes 2 pixels. However, the inventive concept is not limited thereto. For example, the number of pixels in each gate pixel row may decrease every gate pixel row. According to another example embodiment, gate pixel rows may include the same number of pixels, and the number of pixels in the $9^{th}$ gate pixel row may be smaller than that in each of the $7^{th}$ and $8^{th}$ gate pixel rows.

In FIGS. 3 and 4, there is illustrated an example where the number of pixels in the increasing area A1 is equal to that in the decreasing area A3. However, the inventive concept is not limited thereto. The increasing area A1 and the decreasing area A3 may include different numbers of pixels according to the size and shape of the display panel 100.

The display area AA further comprises gate dummy lines GM, data dummy lines DM, a data contact portion DT, and a gate contact portion GT.

The gate dummy lines GM are parallel with the gate lines GL and are spaced apart from the gate lines GL. The gate dummy lines GM may extend in the third direction DR3. In FIG. 3, the gate dummy lines GM are illustrated as including $1^{st}$ to $4^{th}$ gate dummy lines GM1 to GM4.

The data contact portion DT couples the gate dummy lines GM and the data lines DL at one side of the display area in the second direction DR2.

When seen from the top, one of the gate dummy lines GM1 to GM4 and one of the data lines DL1 to DL10 are overlapped, and the gate dummy lines GM1 to GM4 and the data lines DL1 to DL10 are coupled via the data contact portion DT.

One ends of the gate dummy lines GM1 to GM4 are coupled to the data contact portion DT, and the other ends thereof are located at the non-display area NA.

Among the gate dummy lines GM1 to GM4, a gate dummy line located between an nth gate pixel row (n being a natural number) and an $n+1^{st}$ gate pixel row is coupled to a data line that is coupled to a first pixel (pixel immediately adjacent to the data contact portion DT) of the $n+1^{st}$ gate pixel row, from among the data lines DL1 to DL10. For example, a $2^{nd}$ gate dummy line GM2 located between a $1^{st}$ gate pixel row and a $2^{nd}$ gate pixel row is coupled to a $3^{rd}$ data line DL3 that is coupled to a first pixel PX2_1 of the $2^{nd}$ gate pixel row.

The data dummy lines DM are parallel with the data lines DL and are spaced apart from the data lines DL. The data dummy lines DM may extend in the fourth direction DR4. In FIG. 3, the data dummy lines DM are illustrated as including first to third data dummy lines DM1 to DM3.

The gate contact portion GT couples the data dummy lines DM and the gate lines GL at the other end of the display area in the second direction DR2.

When seen from the top, one of the data dummy lines DM1 to DM3 and one of the gate lines GL1 to GL9 are overlapped, and the dummy lines DM1 to DM3 and the gate lines GL1 to GL9 are coupled via the gate contact portion GT.

One ends of the data dummy lines DM1 to DM3 are coupled to the gate contact portion GT, and the other ends thereof are located within the non-display area NA.

Among the data dummy lines DM1 to DM3, a data dummy line located between an nth data pixel row (n being a natural number) and an $n+1^{st}$ data pixel row is coupled to a gate line that is coupled to the last pixel (pixel immediately adjacent to the gate contact portion GT) of the $n+1^{st}$ data pixel row, from among the gate lines GL1 to GL9. For example, a $3^{rd}$ data dummy line DM3 located between a $1^{st}$ data pixel row PX6_8 and a $2^{nd}$ data pixel row (PX5_8, PX6_7, PX7_6) is coupled to a $7^{th}$ gate line GL7 coupled to the last pixel PX7_6 of the $2^{nd}$ data pixel row.

With the structure of the display panel 100 of the inventive concept, the gate lines GL and the gate dummy lines GM are coupled by the data contact portion DT at one end of the display area in the second direction DR2, and the data lines DL and the data dummy lines DM are coupled by the gate contact portion GT at the other end of the display area in the second direction DR2. With this structure, it is possible to remove or minimize a non-display area at a periphery of the second direction DR2 of the display area AA. Accordingly, the display panel 100 includes a non-display area NA for formation of a pad portion at one end in the first direction DR1, and bezels corresponding to three remaining edges of the display panel 100 may be removed or minimized.

Figure 5:
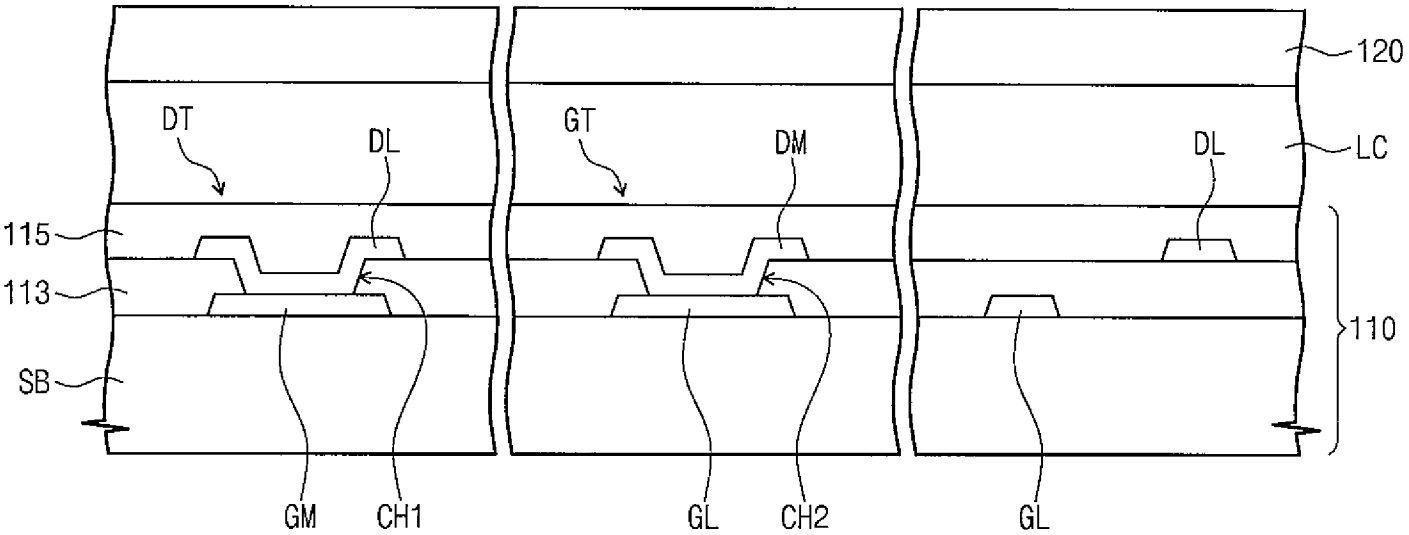
FIG. 5 is a sectional view of a display panel including a data contact portion and a gate contact portion.

FIG. 5 is a sectional view of a display panel including a data contact portion and a gate contact portion.

In FIG. 5, a display panel 100 is illustrated as being a liquid crystal display panel.

Referring to FIGS. 3 and 5, the display panel 100 includes a bottom substrate 110, a top substrate 120, and a liquid crystal layer LC. The bottom and top substrates 110 and 120 are arranged to be opposite to each other. The liquid crystal layer LC is located between the bottom and top substrates 110 and 120.

The bottom substrate 110 includes a data contact portion DT and a gate contact portion GT. The bottom substrate 110 contains an insulation substrate SB.

Gate dummy lines GM and gate lines GL are located on the insulation substrate SB. The gate dummy lines GM and gate lines GL are located at the same layer.

A first insulation film 113 is formed on the gate lines GL and the gate dummy lines GM. The first insulation film 113 is formed of an organic insulation film or an inorganic insulation film. The first insulation film 113 has a first contact hole CH1 that exposes a part of the gate dummy line GM in the data contact portion DT and a second contact hole CH2 that exposes a part of the gate line GL in the gate contact portion GT.

A data line DL and a data dummy line DM may be located on the first insulation film 113. The data line DL and the data dummy line DM may be located at the same layer.

In the data contact portion DT, the data lines DL contacts with the gate dummy line GM via the first contact hole CH1. In the gate contact portion GT, the data dummy line DM contacts the gate line GL via the second contact hole CH2.

A second insulation film 115 is formed on the data lines DL and the data dummy lines DM. The second insulation film 115 is formed of an organic insulation film or an inorganic insulation film.

According to an embodiment, FIG. 5 shows a bottom gate structure in which a gate line GL is formed under a data line DL. However, the inventive concept is not limited thereto. For example, in case of a top gate structure, a gate line GL may be formed above a data line DL.

Figure 6:
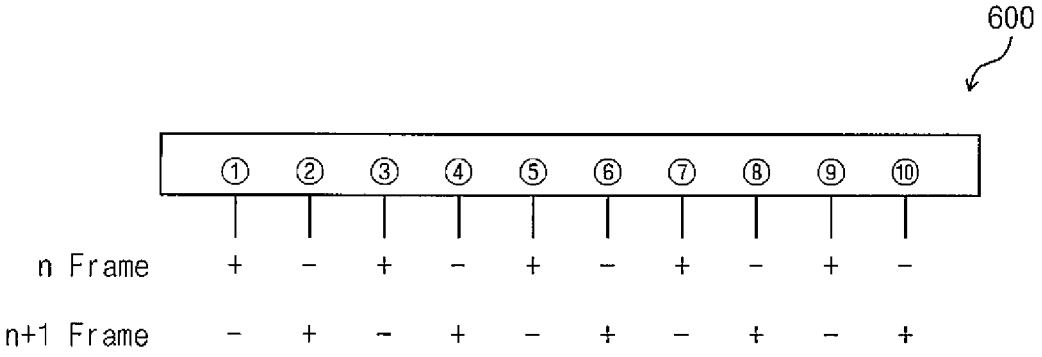
FIG. 6 is a diagram schematically illustrating an integrated circuit chip on a data driver shown in FIG. 2 is mounted.
Figure 7:
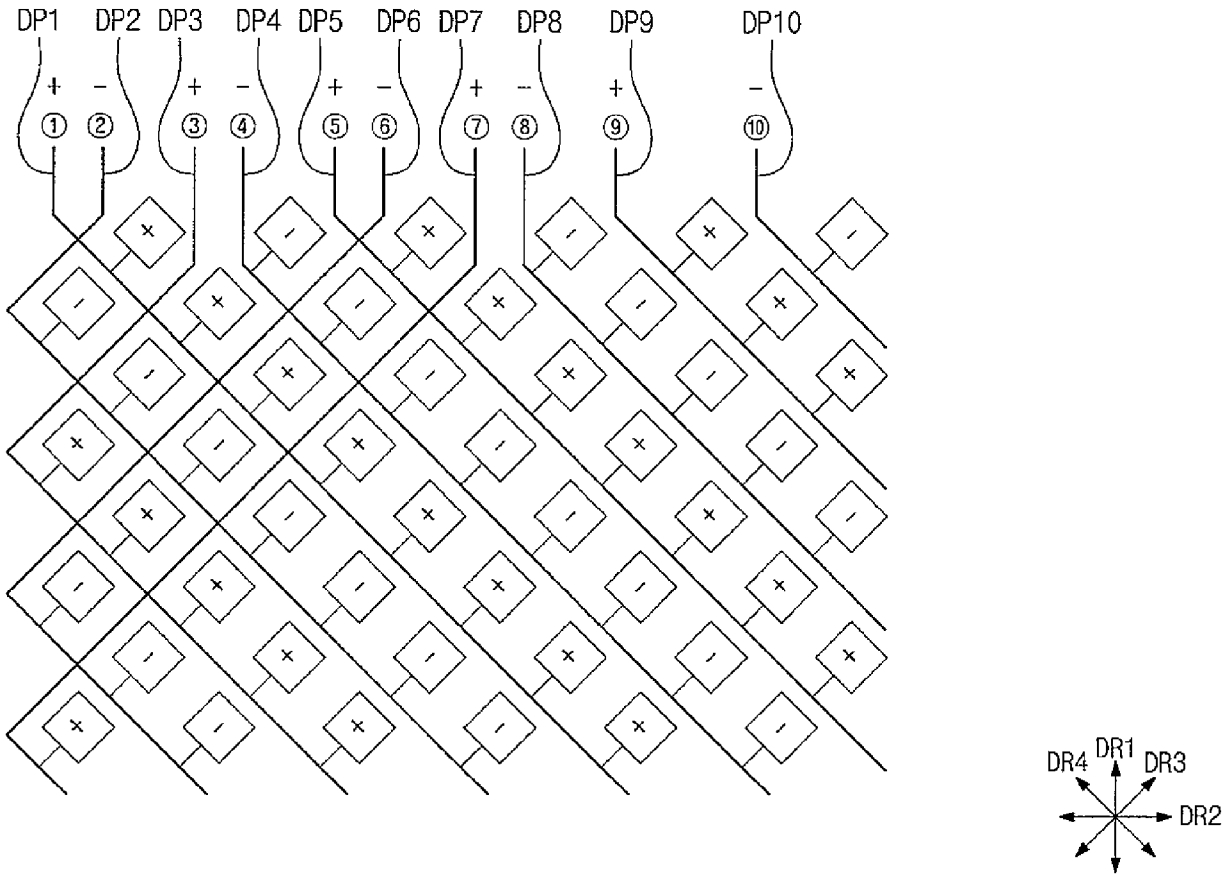
FIG. 7 is a diagram schematically illustrating polarity-marked pixels and data paths through which data voltages are applied.

FIG. 6 is a diagram schematically illustrating an integrated circuit chip on a data driver (shown in FIG. 2) that is mounted. FIG. 7 is a diagram schematically illustrating polarity-marked pixels and data paths through which data voltages are applied.

Referring to FIGS. 2 and 6, a data driver 600 includes a plurality of channels ① to ⑩. A polarity of a data voltage is inverted in turn by the channel and is output to the channels ① to ⑩. In FIG. 6, "+" represents a data voltage with a positive polarity, and "−" represents a data voltage with a negative voltage. FIG. 6 shows an example where, during an nth frame, the data driver 600 alternately outputs a data voltage with a positive polarity and a data voltage with a negative voltage through the channels ① to ⑩ by the channel.

The data driver 600 may invert polarities of data voltages output through the channels ① to ⑩ every frame. The data driver 600 may be configured such that polarities of data voltages output during the nth frame are opposite to polarities of data voltages output during the n+1$^{st}$ frame.

Referring to FIGS. 6 and 7, data paths include 1$^{st}$ to 10$^{th}$ data paths DP1 to DP10 that are coupled to the channels ① to ⑩, respectively.

Each of the 1$^{st}$ to 10$^{th}$ data paths DP1 to DP10 may be formed of a data line DL or include a data line DL, a data contact portion DT, and a gate dummy line GM. For example, the 1$^{st}$ data path DP1 is formed of a 5$^{th}$ data line DL5, and the 2$^{nd}$ data path DP2 contains a 4$^{th}$ data line DL4, a 1$^{st}$ gate dummy line GM1, and a data contact portion DT coupled between the 4$^{th}$ data line DL4 and the 1$^{st}$ gate dummy line GM1.

The 1$^{st}$ to 10$^{th}$ data paths DP1 to DP10 may include an intersection data pair and a non-intersection data pair. The intersection data pair contains two data paths that are coupled to two adjacent channels and intersects. The non-intersection data pair includes two data paths that are coupled to two adjacent channels and do not intersect with each other. For example, the 1$^{st}$ and 2$^{nd}$ data paths DP1 and DP2 form the intersection data pair because they are coupled to two adjacent channels ① and ② and intersect. The 3$^{rd}$ and 4$^{th}$ data paths DP3 and DP4 form the non-intersection data pair because they are coupled to two adjacent channels ③ and ④ and do not intersect with each other.

The data paths DP1 to DP10 are configured such that the intersection data pair and the non-intersection data pair are alternately arranged in turn. In this case, the intersection data pairs are not continuous. In FIG. 7, data paths are illustrated as including 1$^{st}$ and 2$^{nd}$ data paths DP1 and DP2 forming the intersection data pair, 3$^{rd}$ and 4$^{th}$ data paths DP3 and DP4 forming the non-intersection data pair, 5$^{th}$ and 6$^{th}$ data paths DP5 and DP6 forming the intersection data pair, 7$^{th}$ and 8$^{th}$ data paths DP7 and DP8 forming the non-intersection data pair, and 9$^{th}$ and 10$^{th}$ data paths DP9 and DP10 forming the non-intersection data pair in this order.

If the data paths DP1 to DP10 are arranged arbitrarily, it may be difficult to use a part of the channels, which output data voltages with different polarities for two adjacent data pixel rows to receive data voltages with different polarities.

With the display device of the inventive concept, the data paths DP1 to DP10 are arranged such that at least one intersection data pair and at least one non-intersection data pair are alternately arranged. Since the intersection data pair is not continuous, it is possible to efficiently use (or utilize) channels for outputting data voltages with alternate different polarities such that two adjacent data pixel rows receive data voltages with different polarities.

Referring to FIGS. 3, 4, and 7, the number of pixels in each of gate pixel rows PXR1 to PXR9 is even. For example, the 1$^{st}$ gate pixel row PXR1 is formed of two pixels PX1_1 and PX1_2, and the 2$^{nd}$ gate pixel row PXR2 is formed of four pixels PX2_1 to PX2_4.

Polarities of data voltages applied to the gate pixel rows PXR1 to PXR9 are inverted by the pixel. In detail, two adjacent data pixel rows receive data voltages with different polarities, and the same polarity of data voltage is applied to pixels that form a data pixel row. In FIG. 7, a "+" pixel is a pixel that is supplied with a positive polarity of data voltage, and a "−" pixel is a pixel that is supplied with a negative polarity of data voltage.

A polarity of a data voltage applied to a first pixel of each of the gate pixel rows PXR1 to PXR9 is different from that applied to the last pixel thereof. Referring to the 2$^{nd}$ gate pixel row PXR2, for example, a positive polarity of data voltage is applied to a first pixel PX2_1 and a negative polarity of data voltage is applied to the last pixel PX2_4.

With the display device of the inventive concept, since the number of pixels in each of gate pixel rows PXR1 to PXR9 is even, it is possible to efficiently use (or utilize) channels for outputting data voltages with alternate different polarities such that two adjacent data pixel rows receive data voltages with different polarities.

Figure 8:
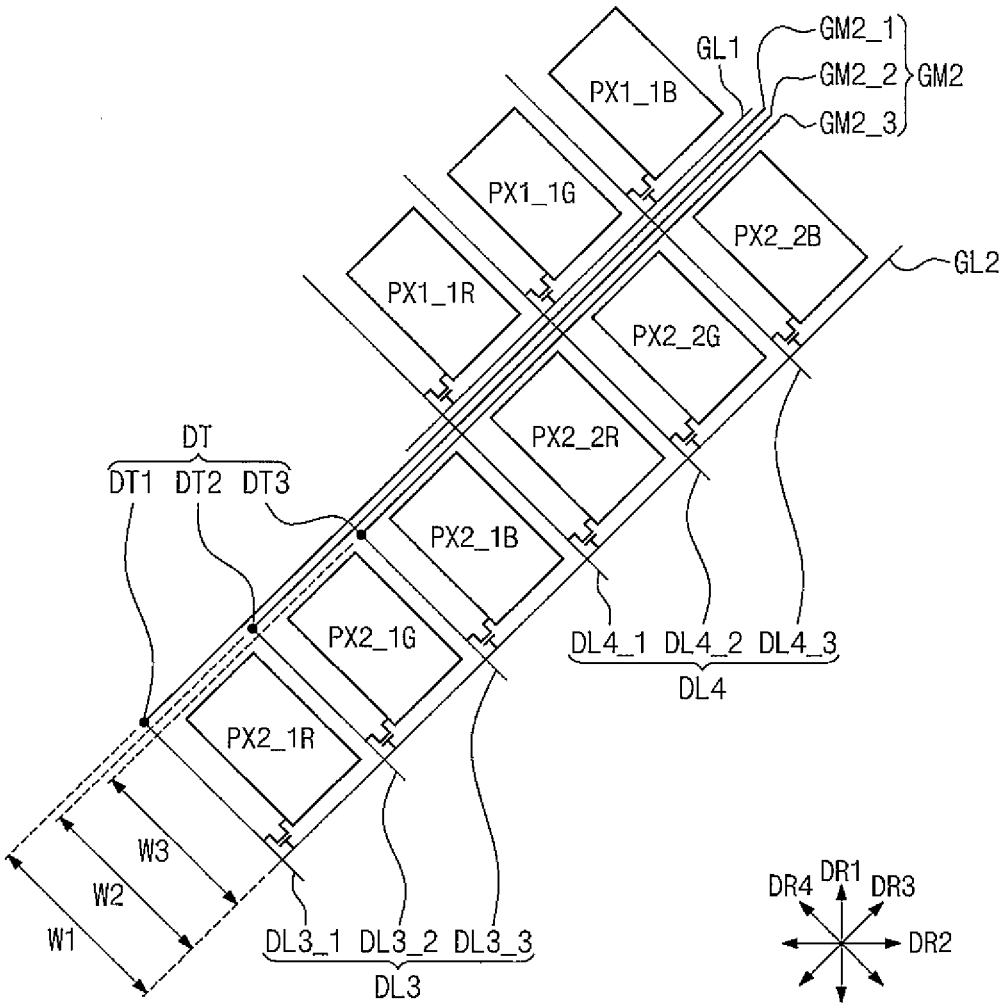
FIG. 8 is a plan view of pixels coupled to 1st and 2nd gate lines and 3rd and 4th data lines in FIG. 3.

FIG. 8 is a plan view of pixels coupled to the 1$^{st}$ and 2$^{nd}$ gate lines GL1 and GL2 and the 3$^{rd}$ and 4$^{th}$ data lines DL3 and DL4 of FIG. 3.

Referring to FIGS. 3, 4, and 8, each of pixels PX1_1 to PX9_2 includes k sub-pixels (k being a natural number of 2 or more). The sub-pixels are arranged to be adjacent in a third direction DR3 extending in a direction of the gate lines GL.

Each of data lines DL1 to DL6 includes k sub data lines coupled to the sub-pixels, respectively. Each of gate dummy lines GM1 to GM4 includes k sub gate dummy lines coupled to the sub data lines, respectively. The sub gate dummy lines are spaced apart from one another and are parallel with one another. A data contact portion DT includes k sub data contact portions that are respectively coupled to the k sub data lines and the k sub gate dummy lines.

An example embodiment of a $2^{nd}$-row first pixel PX2_1 and its periphery will now be described where k is 3.

The $2^{nd}$-row first pixel PX2_1 includes a $1^{st}$ sub-pixel PX2_1R, a $2^{nd}$ sub-pixel PX2_1G, and a $3^{rd}$ sub-pixel PX2_1B, which are sub-pixels displaying red, green, and blue, respectively. Meanwhile, a $1^{st}$-row first pixel PX1_1 includes three sub-pixels PX1_1R, PX1_1G, and PX1_1B, and a $2^{nd}$-row second pixel PX2_2 includes three sub-pixels PX2_2R, PX2_2G, and PX2_2B.

A $3^{rd}$ data line DL3 includes a $1^{st}$ sub data line DL3_1, a $2^{nd}$ sub data line DL3_2, and a $3^{rd}$ sub data line DL3_3. The $1^{st}$ sub data line DL3_1 is coupled to a $1^{st}$ sub-pixel PX2_1R, the $2^{nd}$ sub data line DL3_2 is coupled to a $2^{nd}$ sub-pixel PX2_1G, and the $3^{rd}$ sub data line DL3_3 is coupled to a $3^{rd}$ sub-pixel PX2_1B. The $1^{st}$ to $3^{rd}$ sub data lines DL3_1 to DL3_3 are spaced apart from one another to be parallel with one another. Meanwhile, a $4^{th}$ data line DL4 includes three sub data lines DL4_1 to DL4_3.

The $2^{nd}$ gate dummy line GM2 contains $1^{st}$ to $3^{rd}$ sub gate dummy lines GM2_1 to GM2_3. The $1^{st}$ sub gate dummy line GM2_1 is coupled to the $1^{st}$ sub data line, the $2^{nd}$ sub gate dummy line GM2_2 is coupled to the $2^{nd}$ sub data line DL3_2, and the $3^{rd}$ sub gate dummy line GM2_3 is coupled to the $3^{rd}$ sub data line DL3_3.

A data contact portion DT has $1^{st}$ to $3^{rd}$ sub data contact portions DT1 to DT3. The $1^{st}$ sub data contact portion DT1 couples the $1^{st}$ sub data line DL3_1 and the $1^{st}$ sub gate dummy line GM2_1. The $2^{nd}$ sub data contact portion DT2 couples the $2^{nd}$ sub data line DL3_2 and the $2^{nd}$ sub gate dummy line GM2_2. The $3^{rd}$ sub data contact portion DT3 couples the $3^{rd}$ sub data line DL3_3 and the $3^{rd}$ sub gate dummy line GM2_3. A length of the $1^{st}$ sub gate dummy line GM2_1 is longer than that of the $2^{nd}$ sub gate dummy line GM2_2, and a length of the $2^{nd}$ sub gate dummy line GM2_2 is longer than that of the $3^{rd}$ sub gate dummy line GM2_3.

A distance W1 between the $1^{st}$ sub gate dummy line GM2_1 and the $2^{nd}$ gate line GL2, coupled to the $1^{st}$, $2^{nd}$, and $3^{rd}$ sub pixels PX2_1R, PX2_1G, and PX2_1B, from among the gate lines GL is wider than a distance W2 between the $2^{nd}$ sub gate dummy line GM2_2 and the $2^{nd}$ gate line GL2, coupled to the $1^{st}$, $2^{nd}$, and $3^{rd}$ sub pixels PX2_1R, PX2_1G, and PX2_1B, from among the gate lines GL. The distance W2 is wider than a distance W3 between the $3^{rd}$ sub gate dummy line GM2_3 and the $2^{nd}$ gate line GL2, coupled to the $1^{st}$, $2^{nd}$ and $3^{rd}$ sub pixels PX2_1R, PX2_1G, and PX2_1B, from among the gate lines GL.

Figure 9:
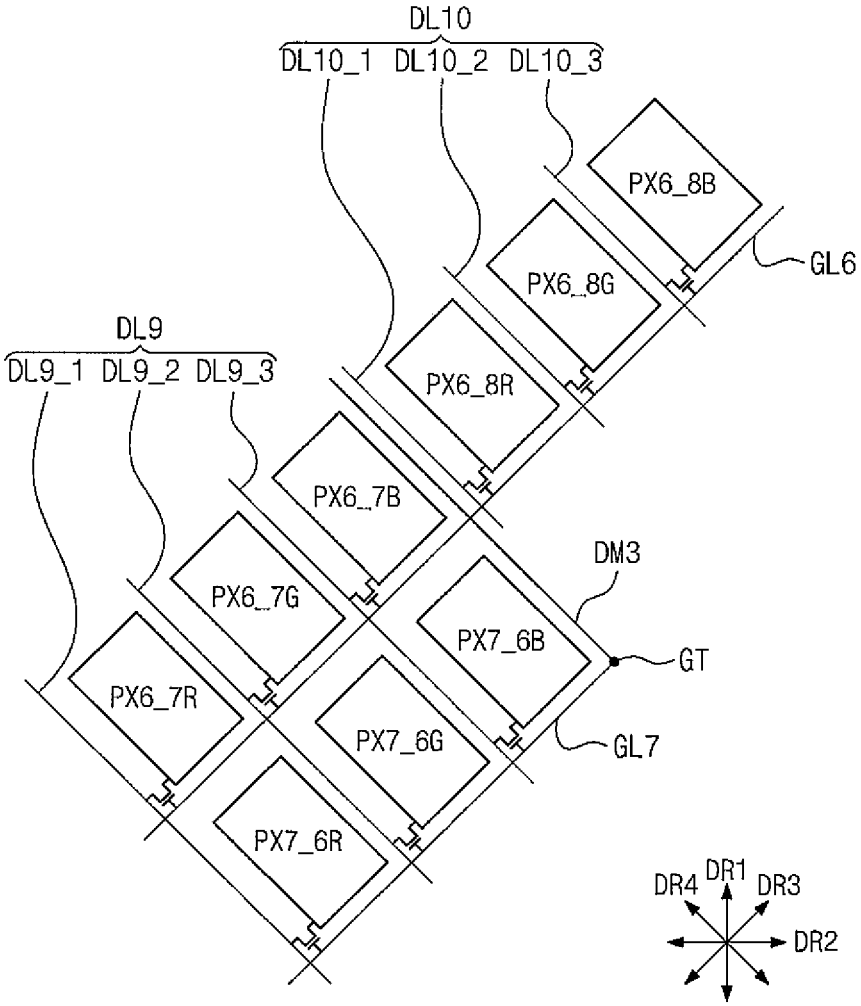
FIG. 9 is a plan view of pixels coupled to 6th and 7th gate lines and 9th and 10th data lines in FIG. 3.

FIG. 9 is a plan view of pixels coupled to the $6^{th}$ and $7^{th}$ gate lines GL6 and GL7 and the $9^{th}$ and $10^{th}$ data lines DL9 and DL10 of FIG. 3.

Referring to FIGS. 3, 4, and 9, a $6^{th}$-row seventh pixel PX6_7 includes three sub-pixels PX6_7R, PX6_7G, and PX6_7B, a $6^{th}$-row eighth pixel PX6_8 includes three sub-pixels PX6_8R, PX6_8G, and PX6_8B, and a $7^{th}$-row sixth pixel PX7_6 includes three sub-pixels PX7_6R, PX7_6G, PX7_6B.

A $9^{th}$ data line DL9 includes three sub data lines DL9_1 to DL9_3, and a $10^{th}$ data line DL10 contains three sub data lines DL10_1 to DL10_3.

A $3^{rd}$ data dummy line DM3 extends in parallel with a data line DL between the $3^{rd}$ sub-pixel PX6_7B of the $6^{th}$-row seventh pixel PX6_7 and the $1^{st}$ sub-pixel PX6_8R of the $6^{th}$-row eighth pixel PX6_8, and is coupled to a $7^{th}$ gate line GL7.

Figure 10:
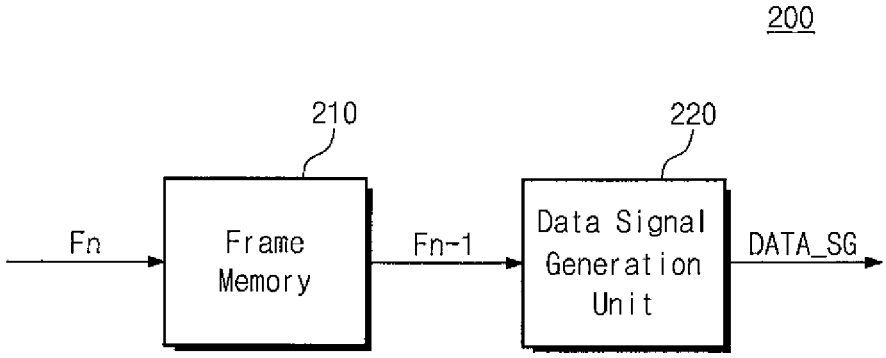
FIG. 10 is a block diagram schematically illustrating a timing controller shown in FIG. 2.

FIG. 10 is a block diagram schematically illustrating a timing controller shown in FIG. 2.

Referring to FIG. 10, a timing controller 400 incorporates a frame memory 410 and a data signal generation unit 420.

The timing controller 400 receives an input image signal DATA_IN by the frame, and the frame memory 410 stores current frame data Fn of the input image signal DATA_IN. The current frame data Fn may become previous frame data Fn−1 after a frame. The frame memory 410 outputs the previous frame data Fn−1.

The data signal generation unit 420 receives and sorts the previous frame data Fn−1 to generate a data signal DATA_SG.

A display panel 100 displays a specific target image. The input image signal DATA_IN is a signal for displaying the target image when gate lines GL extend in a first direction DR1 and data lines DL extend in a second direction DR2. That is, the input image signal DATA_IN is a signal for displaying the target image when the same number of pixels is coupled to the gate lines GL.

The display panel 100 of the inventive concept may rearrange data of the input image signal DATA_IN because the number of pixels coupled to the gate lines GL is different. The input image signal DATA_IN is a signal for displaying the target image when the gate lines GL extend in a third direction DR3 and the data lines DL extend in a fourth direction DR4. That is, the input image signal DATA_IN is a signal for displaying the target image when the number of pixels coupled to the gate lines GL is different.

Figure 11:
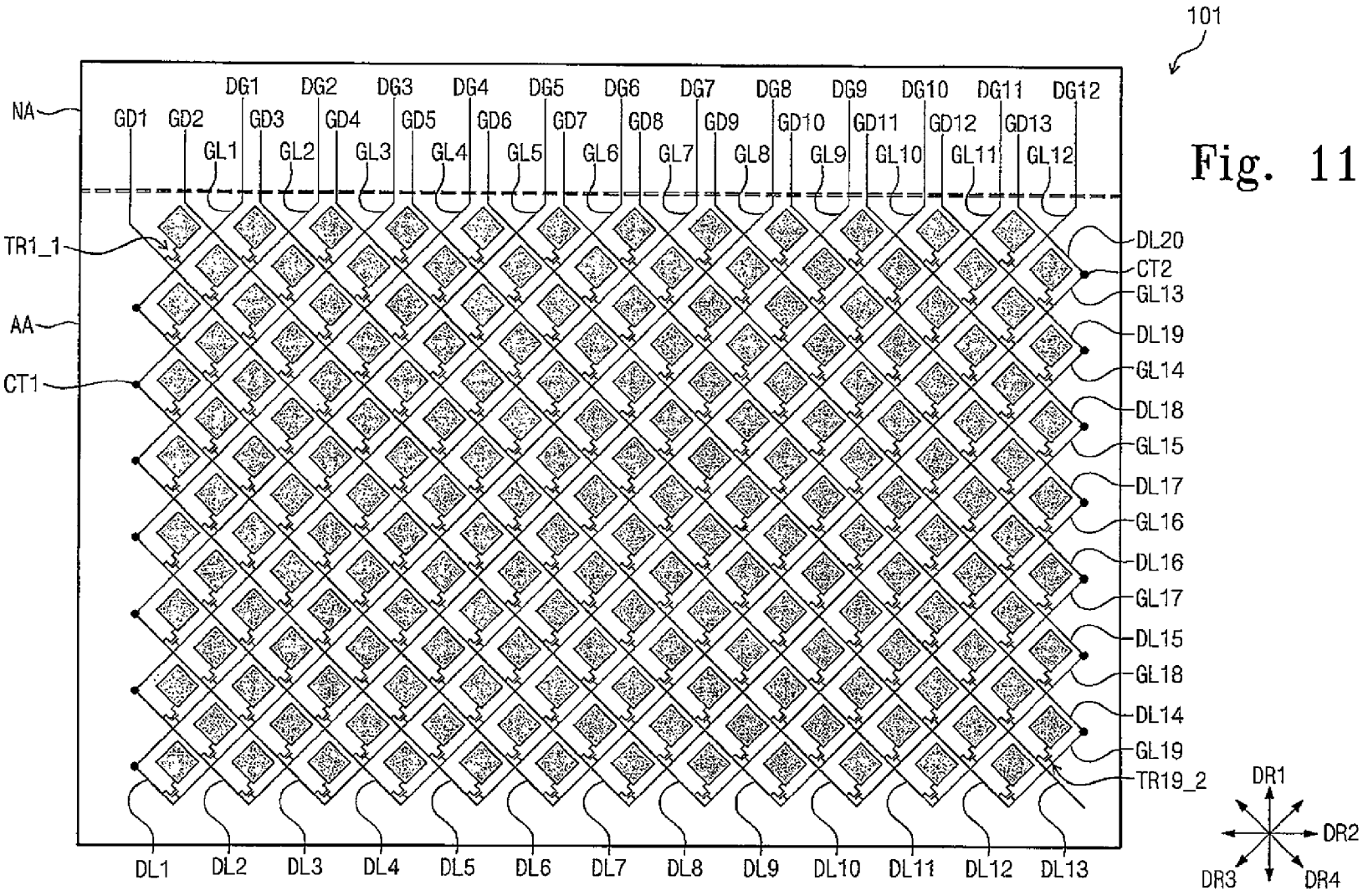
FIG. 11 is a diagram schematically illustrating a display panel according to another embodiment of the inventive concept.
Figure 12:
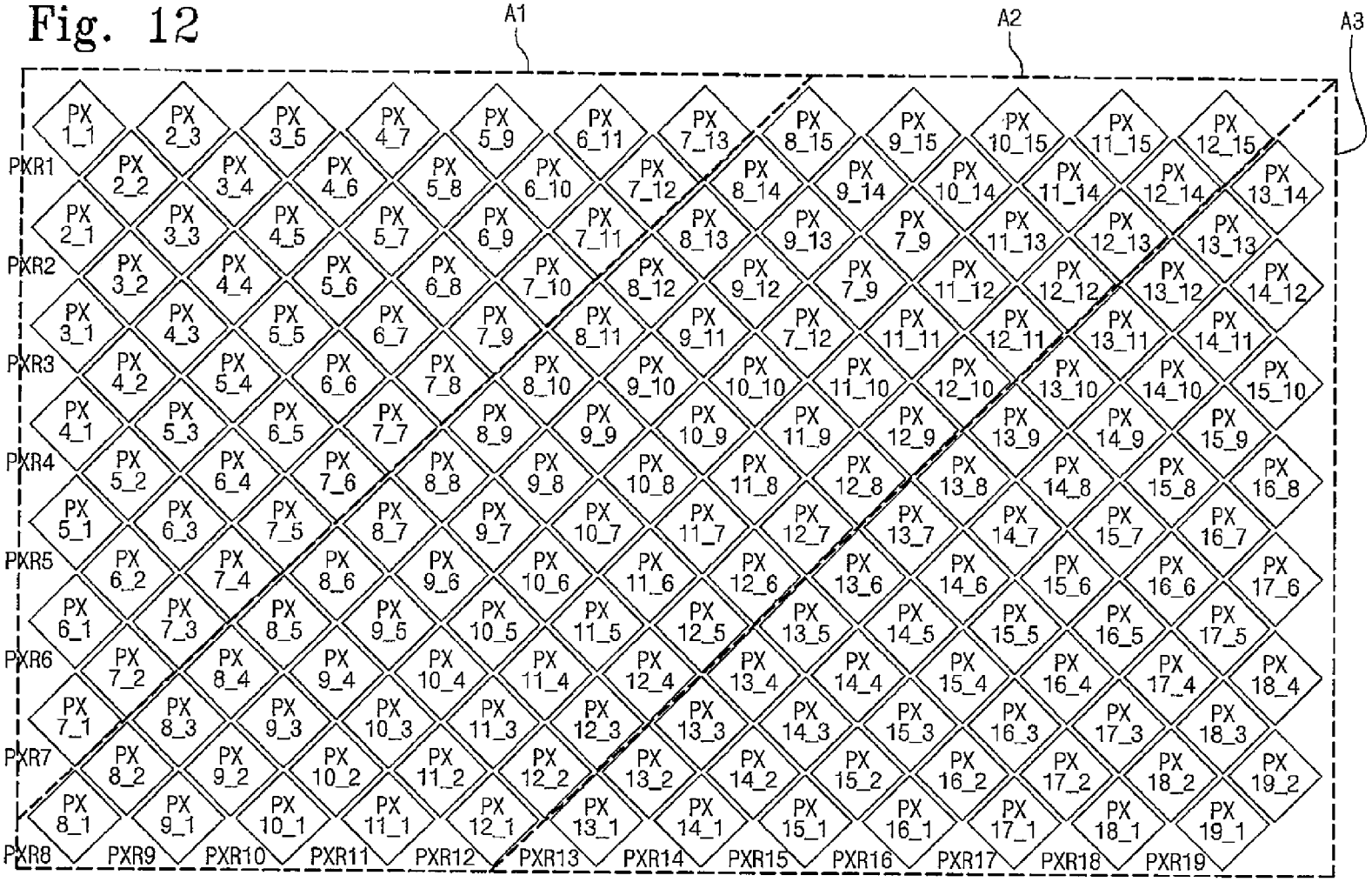
FIG. 12 is a diagram schematically illustrating pixels shown in FIG. 11.
Figure 13:
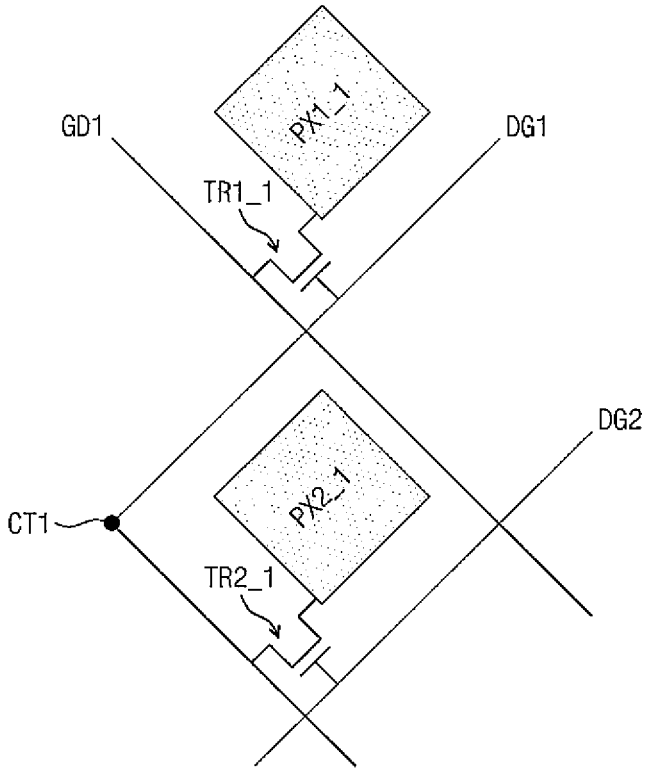
FIG. 13 is an enlarged diagram of a 1st-row first pixel and a 2nd-row first pixel shown in FIG. 11.

FIG. 11 is a diagram schematically illustrating a display panel 101 according to another embodiment of the inventive concept. FIG. 12 is a diagram schematically illustrating pixels shown in FIG. 11. FIG. 13 is an enlarged diagram of a $1^{st}$-row first pixel and a $2^{nd}$-row first pixel shown in FIG. 11.

Referring to FIGS. 11 to 13, a display panel 101 includes a display area AA and a non-display area NA. The display area AA displays images and includes diagonal lines DG, intersectional lines GD, and pixels PX. The non-display area NA may be an area where images are not displayed, and it may be formed at a periphery of the display panel 101. The non-display area NA may be adjacent to one side in the first direction DR1 of the display area AA. A pad portion may be provided in the non-display area NA. The pad portion may be coupled to the diagonal lines DG and the intersectional lines GD to provide the diagonal lines DG and the intersectional lines GD with a gate signal GS from a gate driver 500 (refer to FIG. 2) and a data voltage DATA from a data driver 600 (refer to FIG. 2).

The diagonal lines DG and the intersectional lines GD may extend in a diagonal direction with respect to the first direction DR1 and the second direction DR2. The diagonal lines DG and the intersectional lines GD that extend in the diagonal direction may mean that they extend in a straight-line and they extend in a zigzag pattern such that the extending direction schematically becomes the diagonal direction.

The diagonal lines DG and the intersectional lines GD may be defined on the basis of a direction which extends from one end of the display panel 101 (in FIG. 11, the top of the display panel 101) adjacent to the non-display area NA, in the first direction DR1 of the display area AA. Below, the diagonal lines DG may extend in a third direction DR3 that intersects the first direction DR1 and the second direction DR2 at one end in the first direction DR1 of the display area AA. The intersectional lines GD may extend in a fourth direction DR4 that intersects the first to third directions DR1 to DR3 at one end in the first direction DR1 of the display area AA. An angle between the third direction DR3 and the fourth direction DR4 may be set variously: 30°, 45°, 60°, and so on. Below, the angle between the third direction DR3 and the fourth direction DR4 is 90°.

The diagonal lines DG may be in plurality, and the intersectional lines GD may be in plurality. For example, in FIG. 11, the diagonal lines DG include $1^{st}$ to $12^{th}$ diagonal lines DG1 to DG12, and the intersectional lines GD include $1^{st}$ to $13^{th}$ intersectional lines GD1 to GD13.

The pixels PX are provided at pixel areas that are defined by the diagonal lines DG1 to DG12 and the intersectional lines GD1 to GD13. When viewed from the top, shapes of the pixels PX may be changed or modified variously according to arrangement of the diagonal lines DG and the intersectional lines GD. In FIGS. 11 and 12, there is illustrated an example where each pixel PX has a diamond shape.

Among the pixels PX, pixels that are coupled to a diagonal line DG or an intersectional line GD and are arranged in a line in the third direction DR3 may be defined as a pixel row. The pixel row may include $1^{st}$ to $19^{th}$ pixel rows PXR1 to PXR19.

Below, when a specific pixel is named, a number of a pixel row to which the specific pixel belongs may be marked together with a symbol indicating a location of the specific pixel placed in the pixel row on the basis of the third direction DR3 from a left corner to a right corner. For example, since a pixel PX2_1 coupled to the first diagonal line DG1 and the second diagonal line DG2 is a first pixel of a second pixel row, it is referred to as a $2^{nd}$-row $1^{st}$ pixel PX2_1.

In a similar way, a thin film transistor coupled to the $2^{nd}$-row first pixel PX2_1 is referred to as a $2^{nd}$-row first thin film transistor TR2_1. Thin film transistors coupled to the $2^{nd}$ pixel row PXR2 may be referred to as $2^{nd}$-row thin film transistors.

In a similar way, a data voltage applied to the $2^{nd}$-row first thin film transistor TR2_1 may be referred to as a $2^{nd}$-row first data voltage, and data voltages applied to the $2^{nd}$-row thin film transistors may be referred to as $2^{nd}$-row data voltages.

Also, a gate signal applied to a thin film transistor coupled to a pixel row may be marked by the same reference numeral as the pixel row. For example, a gate signal applied to the $2^{nd}$-row thin film transistors may be referred to as a second gate signal.

In FIGS. 11 and 12, there are illustrated $1^{st}$ to $19^{th}$ pixel rows PXR1 to PXR19, that is, 180 pixels PX1_1 to PX19_2. Also, 180 thin film transistors TR1_1 to TR19_2 coupled to the pixels PX1_1 to PX19_2 may be included.

The number of pixels in one of two adjacent pixel rows may be different from that in the other thereof. The display area AA is divided into three areas by the pixel rows, based on whether the number of pixels in each pixel row increases, is maintained, or decreases on the basis of adjacent pixel rows (or, the second direction DR2). The three areas may include an increasing area A1, a maintaining area A2, and a decreasing area A3.

The increasing area A1 includes $1^{st}$ to $7^{th}$ pixel rows PXR1 to PXR7. The number of pixels in each pixel row may increase in an arithmetic sequence every at least one pixel row toward the seventh pixel row PXR7 from the first pixel row PXR1. Referring to FIGS. 11 and 11, the $1^{st}$ pixel row PXR1 includes one pixel, the $2^{nd}$ pixel row PXR2 includes three pixels, and the seventh pixel row PXR7 includes 13 pixels (1→3→5 . . . →13). That is, the number of pixels may increase by 2 whenever a row changes. However, the inventive concept is not limited thereto. For example, the number of pixels in the $1^{st}$ pixel row may be equal to that in the $2^{nd}$ pixel row. The number of pixels in the $3^{rd}$ pixel row may be equal to that in the $4^{th}$ pixel row, and the number of pixels in each of the $3^{rd}$ and $4^{th}$ pixel rows may be greater than that in each of the $1^{st}$ and $2^{nd}$ pixel rows.

The maintaining area A2 includes $8^{th}$ to $12^{th}$ pixel rows PXR8 to PXR12, which include the same number of pixels. In FIGS. 11 and 12, each of the $8^{th}$ to $12^{th}$ pixel rows PXR8 to PXR12 may include 15 pixels.

The decreasing area A3 includes $13^{th}$ to $19^{th}$ pixel rows PXR13 to PXR19. The number of pixels in each pixel row may decrease in an arithmetic sequence every at least one pixel row toward the $19^{th}$ pixel row PXR19 from the $13^{th}$ pixel row PXR13. Referring to FIGS. 11 and 12, the $13^{th}$ pixel row PXR13 includes 14 pixels, the $14^{th}$ pixel row PXR14 includes 12 pixels, and the $19^{th}$ pixel row PXR19 includes 2 pixels (14→12→10 . . . →2). That is, the number of pixels may decrease by 2 whenever a row changes. However, the inventive concept is not limited thereto. For example, the number of pixels in the $13^{th}$ pixel row may be equal to that in the $14^{th}$ pixel row. The number of pixels in the $18^{th}$ pixel row may be equal to that in the $19^{th}$ pixel row, and the number of pixels in each of the $18^{th}$ and $19^{th}$ pixel rows may be smaller than that in each of the $13^{th}$ and $14^{th}$ pixel rows.

In FIG. 11, there is illustrated an example where the number of pixels in the increasing area A1 is different from that in the decreasing area A3. However, the inventive concept is not limited thereto. The increasing area A1 and the decreasing area A3 may include the same number of pixels according to the size and shape of the display panel 101.

Each of the diagonal lines DG and the intersectional lines GD may include at least one of gate lines GL and data lines DL.

Shapes of the gate and data lines GL and DL will now be described.

When viewed from the top, the gate lines GL may extend in the third direction DR3 and the data lines DL may extend in the fourth direction DR4. The gate lines GL and the data lines DL are located at different layers with an insulation material interposed therebetween. That is, the gate lines GL and the data lines DL are isolated from one another.

The gate lines GL include $1^{st}$ to $19^{th}$ gate lines GL1 to GL19, which are spaced apart from one another in the fourth direction DR4. Each of the $1^{st}$ to $19^{th}$ gate lines GL1 to GL19 is coupled to gate electrodes of thin film transistors coupled to a pixel row. For example, a first gate line GL1 is coupled to a $1^{st}$-row first thin film transistor TR1_1 coupled to a $1^{st}$-row first pixel PX1_1, and a $2^{nd}$ gate line GL2 is coupled to $2^{nd}$-row thin film transistors coupled to a $2^{nd}$ pixel row PX2_1 to PX2_3. Likewise, the $19^{th}$ gate line GL19 is coupled to $19^{th}$-row thin film transistors coupled to the $19^{th}$ pixel row PX19_1 to PX19_2.

The data lines DL may include $1^{st}$ to $20^{th}$ data lines DL1 to DL20, which are spaced apart from one another in the third direction DR3. The $1^{st}$ to $20^{th}$ data lines DL1 to DL20 are coupled to source electrodes of thin film transistors coupled to the pixels PX1_1 to PX19_2.

The display panel 101 further comprises contact portions CT1 and CT2. The gate lines GL and the data lines GL that are overlapped, when viewed from the top, at both ends of the second direction DR2 of the display area AA may be coupled through the contact portions CT1 and CT2. Since the gate lines GL and the data lines GL are located at different layers, the contact portions CT1 and CT2 may be formed as contact holes formed between the gate lines GL and the data lines DL and a conductive material filled in the contact holes.

The contact portions CT1 and CT2 may include a first contact portion CT1 formed at one end in the second direction DR2 of the display area AA and a second contact portion CT2 formed at the other end in the second direction DR2 of the display area AA.

When viewed from the top, a $1^{st}$ gate line GL1 and a $7^{th}$ data line DL7 are overlapped at one end (e.g., a left side of FIG. 11) in the second direction DR2 of the display area AA and are coupled (e.g., interconnected) via the first contact portion CT1. Likewise, each of the remaining gate lines GL2 to GL7 and each of the remaining data lines DL1 to DL6 are overlapped at one end (e.g., a left side of FIG. 11) of the second direction DR2 of the display area AA and are coupled (e.g., interconnected) via the first contact portion CT1.

When viewed from the top, a $13^{th}$ gate line GL13 and a $20^{th}$ data line DL20 are overlapped at the other end (e.g., a right side of FIG. 11) of the second direction DR2 of the display area AA and are coupled (e.g., interconnected) via the second contact portion CT2. Likewise, each of the remaining gate lines GL14 to GL19 and each of the remaining data lines DL14 to DL19 are overlapped at the other end (e.g., a right side of FIG. 11) of the second direction DR2 of the display area AA and are coupled (e.g., interconnected) via the second contact portion CT2.

The diagonal lines DG include diagonal hybrid lines DG1 to DG7 and diagonal gate lines DG8 to DG12.

Each of the diagonal hybrid lines DG1 to DG7 includes a gate line GL, a data line DL, and the first contact portion CT1. In FIG. 11, the diagonal hybrid lines DG1 to DG7 may be $1^{st}$ to $7^{th}$ diagonal lines DG1 to DG7.

Each of the diagonal hybrid lines DG1 to DG7 includes a gate line GL and a data line DL that are coupled (e.g., interconnected) via the first contact portion CT1 at one end of the second direction DR2 of the display area AA. In detail, a $1^{st}$ diagonal line DG1 includes a $1^{st}$ gate line GL1 and a $7^{th}$ data line DL7 that are coupled (e.g., interconnected). Likewise, a $7^{th}$ diagonal line DG7 includes a $7^{th}$ gate line GL7 and a $1^{st}$ data line DL1 that are coupled (e.g., interconnected).

Each of the diagonal gate lines DG8 to DG12 includes a gate line GL. In FIG. 11, the diagonal gate lines DG8 to DG12 may be $8^{th}$ to $12^{th}$ diagonal lines DG8 to DG12.

The diagonal gate lines DG8 to DG12 include $8^{th}$ to $12^{th}$ gate lines GL8 to GL12, respectively. Because the diagonal gate lines DG8 to DG12 are not overlapped with a data line DL at one end of the second direction DR2 of the display area AA when seen from the top, each of the $8^{th}$ to $12^{th}$ gate lines GL8 to GL12 is not coupled to the data line DL.

In the event that the number of diagonal lines DG decreases in proportion to a decrease in the size or plane shape of the display panel 101, diagonal lines DG may only be formed of diagonal hybrid lines.

The intersectional lines GD include intersectional hybrid lines GD7 to GD13 and intersectional data lines GD1 to DG6.

Each of the intersectional hybrid lines GD7 to GD13 includes a gate line GL, a data line DL, and a second contact portion CT2. In FIG. 11, the intersectional hybrid lines GD7 to GD13 may be $7^{th}$ to $13^{th}$ intersectional lines GD7 and GD13.

Each of the intersectional hybrid lines GD7 to GD13 includes a gate line GL and a data line DL that are coupled (e.g., interconnected) via the second contact portion CT2 at the other end in the second direction DR2 of the display area AA. In detail, a $7^{th}$ intersectional line GD7 includes a $19^{th}$ gate line GL19 and a $14^{th}$ data line DL14 that are coupled (e.g., interconnected). Likewise, a $13^{th}$ intersectional line DG13 includes a $13^{th}$ gate line GL13 and a $20^{th}$ data line DL20 that are coupled (e.g., interconnected).

Each of the intersectional data lines GD1 to DG6 includes a data line DL. In FIG. 11, the intersectional data lines GD1 to DG6 may be $1^{st}$ to $6^{th}$ intersectional lines GD1 to GD6.

The intersectional data lines GD1 to DG6 include $8^{th}$ to $13^{th}$ data lines DL8 to DL13, respectively. Because the intersectional data lines GD1 to DG6 are not overlapped with a gate line GL at the other end of the second direction DR2 of the display area AA when seen from the top, each of the $8^{th}$ to $13^{th}$ data lines DL8 to DL13 is not coupled to the gate line GL.

In the event that the number of intersectional lines GD decreases in proportion to a decrease in the size or plane shape of the display panel 101, intersectional lines GD may be formed of intersectional hybrid lines.

The pixels PX1_1 to PX19_2 may be driven by the pixel row. During a $1^{st}$ horizontal period, a first pixel row PXR1 is driven, and pixel rows may be driven sequentially. Thus, a $19^{th}$ pixel row PXR19 may be driven during a $19^{th}$ horizontal period.

In the increasing and decreasing areas A1 and A3, the number of pixels included in one of adjacent pixel rows is different from that included in the other thereof. This may mean that in the increasing and decreasing areas A1 and A3, the number of pixels driven during each of adjacent horizontal periods varies. In the maintaining area A2, the number of pixels included in one of adjacent pixel rows is equal to that included in the other thereof. This may mean that in the maintaining area A2, the number of pixels driven during a horizontal period is maintained the same every horizontal period.

The display panel 101 of the inventive concept has a structure in which gate lines GL and data lines DL are coupled through contact portions CT1 and CT2 at both ends in the second direction DR2 by arrangement of the diagonal lines DG1 to DG12 and the intersectional lines GD1 to GD13. With this structure, a non-display area at a periphery in the second direction DR2 of the display area AA may be removed or minimized. Thus, the display panel 101 includes a non-display area NA for formation of a pad portion at one end of the first direction DR1, and bezels corresponding to three remaining edges may be removed or minimized.

Figure 14:
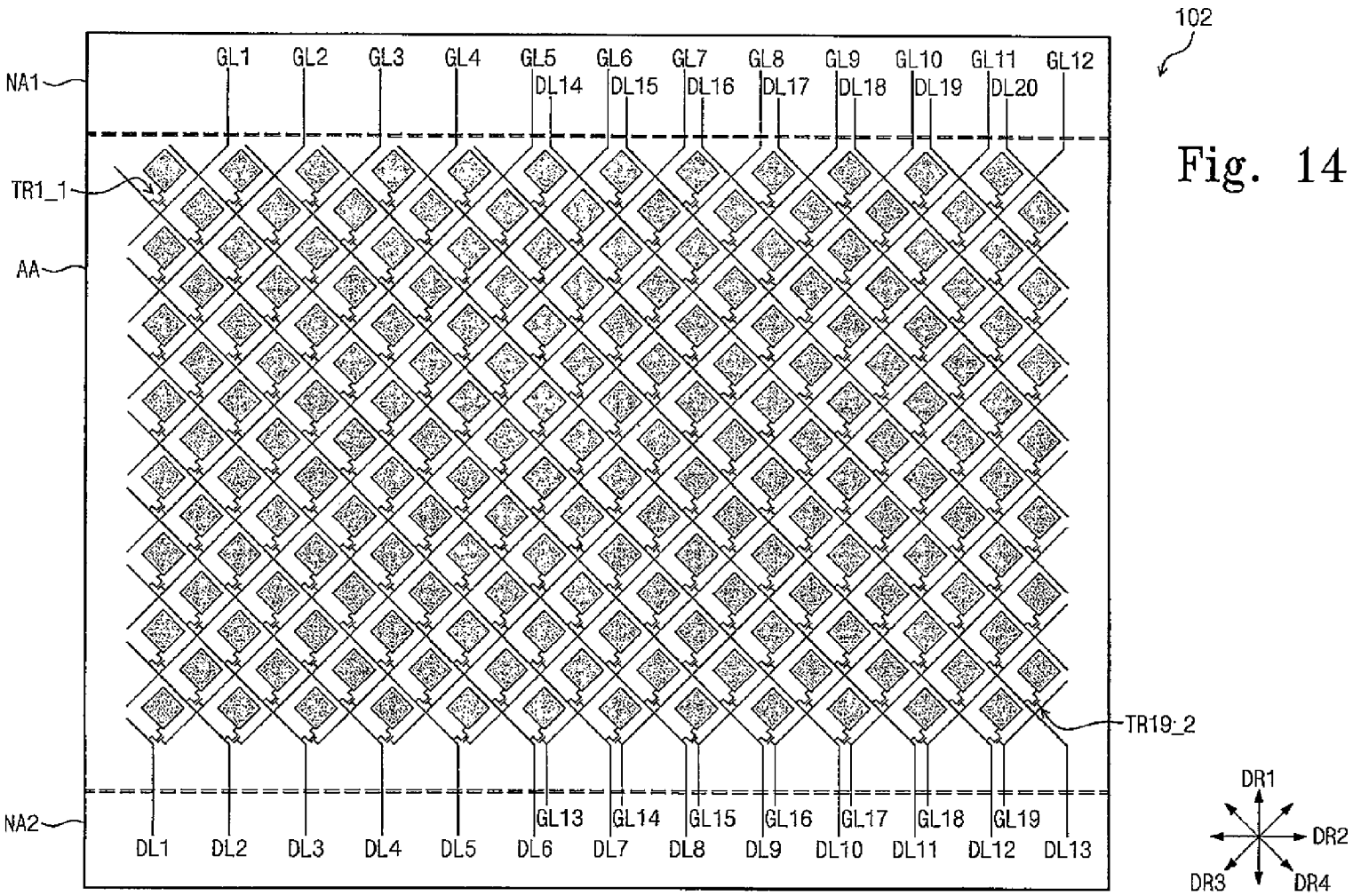
FIG. 14 is a diagram schematically illustrating a display panel of a display device according to an embodiment of the inventive concept.

FIG. 14 is a diagram schematically illustrating a display panel of a display device according to an embodiment of the inventive concept.

A difference between a display panel 102 shown in FIG. 14 and a display panel 101 shown in FIG. 11 will be described. A portion that is not described may comply with the display panel 101 shown in FIG. 11.

Referring to FIG. 14, the display panel 102 includes a display area AA, a first non-display area NA1, and a second non-display area NA2. The display area AA displays images and includes gate lines GL, data lines DL, and pixels PX. The first non-display area NA1 and the second non-display area NA2 are areas where images are not displayed, and they may be formed at a periphery of the display panel 102. The first non-display area NA1 and the second non-display area NA2 are opposite to each other in a first direction DR1 with the display area AA interposed therebetween.

The first non-display area NA1 may include a first pad portion, and the second non-display area NA2 may include a second pad portion. The first and second pad portions are coupled to the gate lines and the data lines to provide the gate lines and the data lines with a gate signal from a gate driver 500 (refer to FIG. 2) and a data voltage from a data driver 600 (refer to FIG. 2).

The gate lines GL and the data lines DL may extend in a diagonal direction with respect to a first direction DR1 and a second direction DR2. The gate lines GL and the data lines DL that extend in the diagonal direction may mean that they extend in a straight-line and/or that they extend in a zigzag pattern such that the extending direction becomes the diagonal direction.

When viewed from the top, the gate lines GL extend in a third direction DR3 and the data lines DL extend in a fourth direction DR4. The gate lines GL and the data lines DL are located at different layers with an insulation material interposed therebetween for isolation.

The gate lines include $1^{st}$ to $19^{th}$ gate lines GL1 to GL19, which are spaced apart from one another in the fourth direction DR4. Each of the $1^{st}$ to $19^{th}$ gate lines GL1 to GL19 is coupled to a gate electrode of each thin film transistor coupled to a pixel row. For example, the $1^{st}$ gate line GL1 is coupled to a $1^{st}$-row first thin film transistor coupled to a $1^{st}$-row first pixel PX1_1, the $2^{nd}$ gate line GL2 is coupled to $2^{nd}$-row thin film transistors coupled to a $2^{nd}$ pixel row PX2, and the $19^{th}$ gate line GL19 is coupled to $19^{th}$-row thin film transistors coupled to a $19^{th}$ pixel row PX19.

The data lines DL include $1^{st}$ to $20^{th}$ data lines DL1 to DL20, which are spaced apart from one another in a third direction DR3. The $1^{st}$ to $20^{th}$ data lines DL1 to DL20 are coupled to source electrodes of thin film transistors TR1_1 to TR19_2 coupled to pixels PX1_1 to PX19_2.

The gate lines GL1 to GL19 are formed of upper gate lines GL1 to GL12 and lower gate lines GL13 to GL19. Also, the data lines DL1 to DL20 are formed of upper data lines DL8 to DL20 and lower data lines DL1 to DL7.

The pixels PX are provided at pixel areas that are defined by the gate lines GL and the data lines DL. Shapes of the pixels PX viewed from the top may be decided variously according to shapes of the gate lines GL and the data lines DL. For example, in FIG. 14, the pixels PX have a diamond shape.

The number of pixels in one of two adjacent pixel rows is different from the number of pixels in the other thereof.

The upper gate lines GL1 to GL12 and the upper data lines DL8 to DL20 may be coupled at the first pad portion. The first pad portion may provide a part of gate signals GS from a gate driver 500 (refer to FIG. 2) and a part of data voltages DATA from a data driver 600 (refer to FIG. 2) to the upper gate lines GL1 to GL12 and the upper data lines DL8 to DL20.

The lower gate lines GL13 to GL19 and the lower data lines DL1 to DL7 may be coupled at the second pad portion. The second pad portion may provide the rest of the gate signals GS from the gate driver 500 and the rest of the data voltages DATA from the data driver 600 to the lower gate lines GL13 to GL19 and the lower data lines DL1 to DL7.

As compared with a display panel 101 shown in FIG. 11, a display panel 102 shown in FIG. 14 does not include a contact portion. Thus, the gate lines GL and the data lines DL are not coupled (e.g., interconnected) at a point where they are overlapped when viewed from the top.

Figure 15:
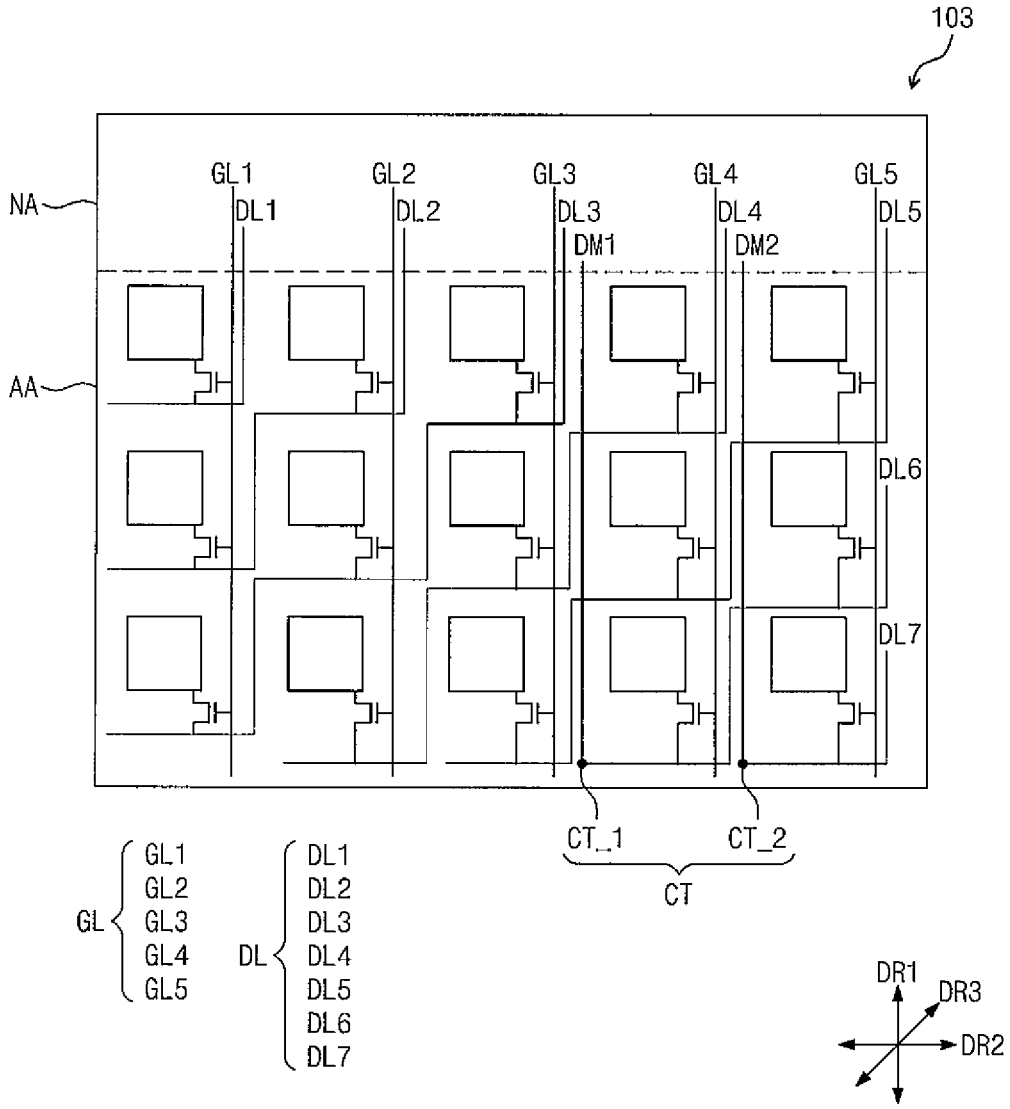
FIG. 15 is a diagram schematically illustrating a display panel of a display device according to an embodiment of the inventive concept.
Figure 16:
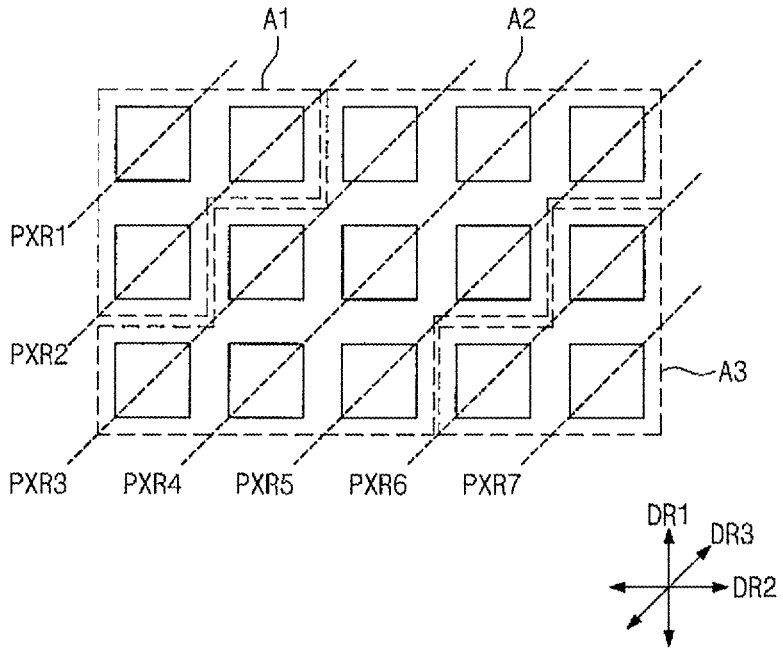
FIG. 16 is a diagram schematically illustrating pixels shown in FIG. 15.

FIG. 15 is a diagram schematically illustrating a display panel of a display device according to an embodiment of the inventive concept. FIG. 16 is a diagram schematically illustrating pixels shown in FIG. 15.

A difference between a display panel 103 shown in FIG. 15 and a display panel 101 shown in FIG. 11 will now be described. A portion that is not described may comply with the display panel 101 shown in FIG. 11.

Referring to FIGS. 15 and 16, the display panel 103 includes a display area AA and a non-display area NA. The display area AA displays images and includes gate lines GL, data lines DL, and pixels PX.

The non-display area NA is an area where images are not displayed, and it may be formed at a periphery of the display panel 103. The non-display area NA is adjacent to one side in a first direction DR1 of the display area AA. The non-display area NA may include a pad portion. The pad portion is coupled to the gate lines and the data lines to provide the gate lines and the data lines with a gate signal from a gate driver 500 (refer to FIG. 2) and a data voltage from a data driver 600 (refer to FIG. 2).

The gate lines GL may extend in a first direction DR1, and the data lines DL may extend in a diagonal direction with respect to the first direction DR1 and a second direction DR2. The data lines DL that extend in the diagonal direction may mean that they extend in a straight-line and/or that they extend in a zigzag pattern such that the extending direction becomes the diagonal direction.

In FIG. 15, there is illustrated an example where the data lines DL extend along the first direction DR1 and the second direction DR2 in a zigzag pattern. An extending direction of the data lines DL is defined as a third direction DR3. The gate lines GL and the data lines DL are located at different layers with an insulation material interposed therebetween for isolation.

The gate lines GL include $1^{st}$ to $5^{th}$ gate lines GL1 to GL5, which are spaced apart from one another in a second direction DR2. The data lines DL include $1^{st}$ to $7^{th}$ data lines DL1 to DL7.

The pixels PX are arranged at pixel areas that are defined by the $1^{st}$ to $5^{th}$ gate lines GL1 to GL5 and $1^{st}$ to $7^{th}$ data lines DL1 to DL7. Shapes of the pixels PX viewed from the top may be decided variously according to shapes of the gate lines GL and the data lines DL. For example, FIGS. 15 and 16 show that the pixels PX are arranged in a matrix form according to the first direction DR1 and the second direction DR2.

The gate lines GL are coupled to the same number of pixels, respectively.

Pixels coupled to a gate line GL and a data line DL, from among the pixels PX may be defined as a pixel row. A pixel row is formed of pixels coupled to a data line DL. The pixel row includes $1^{st}$ to $7^{th}$ pixel rows PXR1 to PXR7.

The number of pixels in one of two adjacent pixel rows may be different from that in the other thereof. The display area AA is divided into three areas by the pixel rows, based on whether the number of pixels in each pixel row increases, is maintained, or decreases on the basis of adjacent pixel rows. The three areas may include an increasing area A1, a maintaining area A2, and a decreasing area A3.

The increasing area A1 includes $1^{st}$ and $2^{nd}$ pixel rows PXR1 and PXR2. The number of pixels in each pixel row may increase in an arithmetic sequence every at least one pixel row toward the $2^{nd}$ pixel row PXR2 from the $1^{st}$ pixel row PXR1.

The maintaining area A2 includes $3^{rd}$ to $5^{th}$ pixel rows PXR3 to PXR5, which include the same number of pixels.

The decreasing area A3 includes $6^{th}$ and $7^{th}$ pixel rows PXR6 to PXR7. The number of pixels in each pixel row may decrease in an arithmetic sequence every at least one pixel row toward the $7^{th}$ pixel row PXR7 from the $6^{th}$ pixel row PXR6.

The display panel 103 further comprises dummy lines DM1 and DM2 and a contact portion CT.

The dummy lines DM1 and DM2 extend in a direction parallel with gate lines GL. The contact portion CT couples data lines DL6 and DL7, which are included in the decreasing area A3, and the dummy lines DM1 and DM2. Here, the data lines DL6 and DL7 and the dummy lines DM1 and DM2 are overlapped at one end of the first direction DR1 of the display area AA when viewed from the top.

The number of contact portions CT and the number of dummy lines may the same as the number of the data lines DL6 and DL7 included in the decreasing area A3.

In detail, the contact portion CT includes a first contact portion CT_1 and a second contact portion CT_2. The first contact portion CT_1 coupled (e.g., interconnected) the dummy line DM1 and the $6^{th}$ data line DL6, and the second contact portion CT_2 coupled (e.g., interconnected) the dummy line DM2 and the $7^{th}$ data line DL7.

The dummy lines DM1 and DM2 are spaced apart from gate lines GL in the second direction DR2 and are located at the same layer as the gate lines GL. Because the dummy lines DM1 and DM2 are located at a layer different from the data lines DL4, DL5, and DL6, the dummy lines DM1 and DM2 may be isolated from the data lines DL4, DL5, and DL6.

One end of the dummy lines DM1 and DM2 are coupled to the contact portion CT, and the other end thereof are located within the non-display area NA. The other ends of the dummy lines DM1 and DM2 may be coupled at a pad portion. The dummy lines DM1 and DM2 receive a part of data voltages DATA that are provided from a data driver 600 (refer to FIG. 2) via the pad portion.

While the inventive concept has been described with reference to example embodiments, it will be apparent to those skilled in the art that various changes and modifications may be made without departing from the spirit and scope of the present invention. Therefore, it should be understood that the above embodiments are not limiting, but illustrative. It is therefore desired that the present embodiments be considered in all respects as illustrative and not restrictive, with reference being made to the appended claims and their equivalents.

What is claimed is:

1. A display device comprising:

a display panel comprising a display area for displaying an image and a non-display area adjacent the display area at one side in a first direction, wherein the display area comprises:

a plurality of gate lines;

a plurality of data lines crossing at least a part of the plurality of gate lines, the at least the part of the plurality of gate lines being isolated from the plurality of data lines;

a plurality of gate dummy lines spaced apart from and being parallel with the plurality of gate lines;

a data contact portion coupling a gate dummy line of the plurality of gate dummy lines and a data line of the plurality of data lines at one side of the display area in a second direction perpendicular to the first direction; and a plurality of pixels each coupled to a gate line of the plurality of gate lines and the data line;

a timing controller configured to output a first control signal, a second control signal, and a data signal in response to an externally supplied control signal and an input image signal;

a gate driver configured to generate a gate signal based on the first control signal, and configured to output the gate signal to the plurality of gate lines via the non-display area; and a data driver comprising a plurality of channels, wherein, based on the second control signal, the data driver is configured to invert a polarity of a data voltage obtained by converting the data signal, by the plurality of channels, and is configured to output the data voltage with the inverted polarity to the plurality of channels, the data voltage being provided to the plurality of data lines via the non-display area.

2. The display device of claim 1, wherein the display area further comprises:

data dummy lines spaced from and parallel with, the plurality of data lines; and a gate contact portion coupling the data dummy lines and the plurality of gate lines at a second side of the display area in the second direction.

3. The display device of claim 2, wherein the display panel comprises two edges extending in the first direction and the second direction, and wherein the plurality of gate lines extend in a third direction intersecting the first and second directions, and wherein the plurality of data lines extend in a fourth direction intersecting the first, second, and third directions.

4. The display device of claim 2, wherein a number of pixels coupled to a gate line from among the pixels is even, and wherein the pixels coupled to the gate line from among the pixels form a gate pixel row.

5. The display device of claim 4, wherein a polarity of a data voltage applied to the gate pixel row is inverted by the pixel.

6. The display device of claim 5, wherein a polarity of a data voltage applied to a first pixel of the gate pixel row is different from a polarity of a data voltage applied to a last pixel of a same gate pixel row.

7. The display device of claim 2, wherein the data voltages applied to pixels coupled to a data line from among the pixels have a same polarity, and wherein the pixels coupled to the data line from among the pixels form a data pixel row.

8. The display device of claim 2, wherein the plurality of pixels coupled to the plurality of gate lines or to the plurality of data lines, from among the plurality of pixels, are defined as a pixel row, wherein the display area further comprises a plurality of areas, each of the plurality of areas comprising a plurality of pixel rows, and wherein a number of pixels in one pixel rows in at least one of the plurality of areas is different from the number of pixels in another pixel row.

9. The display device of claim 8, wherein the plurality of areas comprise:

an increasing area where the number of pixels in each pixel row increases by at least one pixel;

a maintaining area where each of the pixel rows comprise a same number of pixels; and a decreasing area where the number of pixels in each pixel row decreases by at least one pixel.

10. The display device of claim 2, wherein each of the pixels comprises k sub-pixels, wherein k is a natural number of 2 or more, wherein each of the data lines comprises k sub data lines respectively coupled to the sub-pixels, wherein each of the gate dummy lines comprises k sub gate dummy lines respectively coupled to the sub data lines, and wherein the data contact portion comprises k sub data contact portions coupling the k sub data lines and the k sub gate dummy lines.

11. The display device of claim 1, wherein the data driver is configured to invert polarities of data voltages output from the channels every frame.

12. The display device of claim 1, wherein the display area further comprises data paths that are respectively coupled to the channels, and that are configured to receive voltages.

13. The display device of claim 12, wherein the data paths are configured such that at least one intersection data pair formed of two data paths that are coupled to two adjacent channels and that intersect each other, and at least one non-intersection data pair formed of two data paths that are coupled to two adjacent channels and that do not intersect, are arranged alternatingly, such that the intersection data pair is non-continuous.

14. The display device of claim 1, wherein the timing controller comprises:

a frame memory configured to store current frame data of the input image signal and output previous frame data of the input image signal; and a data signal generation unit configured to sort the previous frame data to generate the data signal.

15. The display device of claim 1, wherein the display panel comprises two edges extending in the first direction and the second direction, and is configured to display a target image, wherein the input image signal is a signal for displaying the target image when the plurality of gate lines extend in the first direction and when the plurality of data lines extend in the second direction, and wherein the data signal is a signal for displaying the target image when the plurality of gate lines extend in a third direction intersecting the first and second directions and when the data lines extend in a fourth direction intersecting the first, second, and third directions.

16. A display device comprising:

a display panel comprising a display area configured to display an image, and a non-display area adjacent one side of the display area, the display area comprising two edges extending in a first direction and in a second direction different from the first direction, diagonal lines, intersectional lines intersecting and isolated from at least a part of the diagonal lines, and pixels coupled to a diagonal line or an intersectional line, and arranged in a line in one direction, from among the pixels defined as a pixel row;

a timing controller configured to receive a control signal and an input image signal, and configured to output a first control signal, a second control signal, and a data signal;

a gate driver configured to generate a gate signal based on the first control signal, and configured to output the gate signal to the diagonal lines and to the intersectional lines via the non-display area; and a data driver configured to output a data voltage obtained by converting the data signal to the diagonal lines and to the intersectional lines via the non-display area in response to the second control signal, wherein the display area further comprises a plurality of areas, each of the plurality of areas comprising a plurality of pixel rows, wherein a number of pixels constituting one of the pixel rows in at least one of the plurality of areas is different from the number of pixels constituting another pixel row, wherein the diagonal lines extend in a third direction that intersects, the first direction and the second direction at one end of the display area adjacent the non-display area, wherein the intersectional lines extend in a fourth direction that intersects, the first, second, and third directions, at the one end of the display area, and wherein the timing controller comprises a frame memory configured to store current frame data of the input image signal and output previous frame data of the input image signal and a data signal generation unit adapted to sort the previous frame data to generate the data signal.

17. A display device comprising:

a display panel comprising a display area for displaying an image, a first non-display area adjacent one side of the display area, and a second non-display area adjacent another side of the display area, the display area comprising two edges extending in first and second directions that are different from each other, gate lines, data lines crossing and isolated from at least a part of the gate lines, and pixels coupled to a gate line or a data line from among the pixels defined as a pixel row;

a timing controller configured to receive a control signal and an input image signal, and configured to output a first control signal, a second control signal, and a data signal;

a gate driver configured to generate a gate signal based on the first control signal, and configured to output the gate signal to the gate lines via the first and second non-display areas; and a data driver configured to output a data voltage obtained by converting the data signal to the data lines via the first and second non-display areas in response to the second control signal, wherein the display area further comprises a plurality of areas, each of the plurality of areas comprising a plurality of pixel rows, wherein a number of pixels constituting one of the pixel rows in at least one of the plurality of areas is different from the number of pixels constituting another pixel row, wherein the gate lines extend a third direction intersecting the first and second directions, wherein the data lines extend a fourth direction intersecting the first, second, and third directions, and wherein the timing controller comprises:

a frame memory configured to store current frame data of the input image signal, and configured to output previous frame data of the input image signal; and a data signal generation unit configured to sort the previous frame data to generate the data signal.

18. A display device comprising:

a display panel comprising a display area configured to display an image, and a non-display area adjacent one side of the display area, the display area comprising two edges extending in a first direction and a second direction different from the first direction, gate lines, data lines intersecting and isolated from at least a part of the gate lines, and pixels coupled to a gate line or a data line, from among the pixels being defined as a pixel row;

a timing controller configured to receive a control signal and an input image signal, and configured to output a first control signal, a second control signal, and a data signal;

a gate driver configured to generate a gate signal based on the first control signal, and configured to output the gate signal to the gate lines via the non-display area; and a data driver configured to output a data voltage obtained by converting the data signal to the data lines via the non-display area in response to the second control signal, wherein the display area further comprises a plurality of areas, each of the plurality of areas comprising a plurality of pixel rows, wherein a number of pixels constituting one of the pixel rows in at least one of the plurality of areas is different from the number of pixels constituting another pixel row, wherein the gate lines extend in the first direction, wherein the data lines extend in a third direction crossing the first direction and the second direction, and wherein the timing controller comprises:

a frame memory configured to store current frame data of the input image signal, and configured to output previous frame data of the input image signal; and a data signal generation unit adapted to sort the previous frame data to generate the data signal.

* * * * *